US011244598B2

(12) United States Patent
Yue et al.

(10) Patent No.: US 11,244,598 B2
(45) Date of Patent: Feb. 8, 2022

(54) PIXEL CIRCUIT, DRIVING METHOD, AND DISPLAY APPARATUS

(71) Applicant: BOE Technology Group Co., Ltd., Beijing (CN)

(72) Inventors: Han Yue, Beijing (CN); Xiaochuan Chen, Beijing (CN); Minghua Xuan, Beijing (CN); Can Zhang, Beijing (CN); Can Wang, Beijing (CN); Ming Yang, Beijing (CN); Ning Cong, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 286 days.

(21) Appl. No.: 16/612,927

(22) PCT Filed: Jan. 7, 2019

(86) PCT No.: PCT/CN2019/070610
§ 371 (c)(1),
(2) Date: Nov. 12, 2019

(87) PCT Pub. No.: WO2020/048075
PCT Pub. Date: Mar. 12, 2020

(65) Prior Publication Data

US 2021/0407376 A1 Dec. 30, 2021

(30) Foreign Application Priority Data

Sep. 7, 2018 (CN) ..... 201811042306.8

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01); *G09G 2300/0814* (2013.01);
(Continued)

(58) Field of Classification Search
CPC ..... G09G 3/32; G09G 3/2007; G09G 2300/0814; G09G 2300/0852;
(Continued)

(56) References Cited

U.S. PATENT DOCUMENTS

2006/0170636 A1 8/2006 Nakamura et al.
2008/0192029 A1* 8/2008 Anderson ..... G09G 3/3466 345/204
(Continued)

FOREIGN PATENT DOCUMENTS

CN 1819001 A 8/2006
CN 101754533 A 6/2010
(Continued)

OTHER PUBLICATIONS

First Office Action in the Chinese Patent Application No. 201811042306.8, dated Jul. 16, 2021; English translation attached.

*Primary Examiner* — Andrew Sasinowski
(74) *Attorney, Agent, or Firm* — Intellectual Valley Law, P.C.

(57) ABSTRACT

The present application discloses pixel circuit including a current-control circuit coupled respectively to a first data-signal terminal, a first voltage terminal, a first scan-signal terminal, and a first output node. The current-control circuit is configured to output a driving current to the first output node based on a first data signal and a first voltage signal in response to a first scan signal. The pixel circuit further includes a timing-control circuit coupled respectively to a second data-signal terminal, a second scan-signal terminal, multiple modulation-signal terminals, the first output node, and a second output node. The timing-control circuit is configured to select one modulation signal based on a second data signal in response to a second scan signal and to output the driving current from the current-control circuit
(Continued)

via the second output node to a light-emitting device based on the modulation signal.

20 Claims, 13 Drawing Sheets

(52) U.S. Cl.
CPC ..... *G09G 2300/0852* (2013.01); *G09G 2310/0267* (2013.01); *G09G 2310/0275* (2013.01); *G09G 2310/08* (2013.01)

(58) Field of Classification Search
CPC ... G09G 2310/0267; G09G 2310/0275; G09G 2310/08
See application file for complete search history.

(56) References Cited

U.S. PATENT DOCUMENTS

2010/0156317 A1 6/2010 Arai
2013/0320874 A1 12/2013 Dobler
2015/0317935 A1* 11/2015 Pappas ..... G09G 3/3433 345/85
2015/0348491 A1* 12/2015 Kim ..... G09G 5/18 345/212
2017/0039950 A1 2/2017 Li et al.
2017/0084234 A1* 3/2017 Shin ..... G11C 19/28
2017/0262095 A1* 9/2017 Reynolds ..... G06F 3/04166
2017/0287414 A1* 10/2017 Uriostigue ..... G09G 3/2003
2019/0347980 A1* 11/2019 Kuo ..... G09G 3/32
2019/0347994 A1* 11/2019 Lin ..... G09G 3/32

FOREIGN PATENT DOCUMENTS

CN 103458564 A 12/2013
CN 104599637 A 5/2015
CN 104992663 A 10/2015
CN 108320712 A 7/2018
CN 108470537 A 8/2018
JP H10274951 A 10/1998

* cited by examiner

PIXEL CIRCUIT, DRIVING METHOD, AND DISPLAY APPARATUS

CROSS-REFERENCE TO RELATED APPLICATION

This application is a national stage application under 35 U.S.C. § 371 of International Application No. PCT/CN2019/070610 filed Jan. 7, 2019, which claims priority to Chinese Patent Application No. 201811042306.8, filed Sep. 7, 2018, the contents of which are incorporated by reference in the entirety.

TECHNICAL FIELD

The present invention relates to display technology, more particularly, to a pixel circuit, a driving method for the pixel circuit, and a display apparatus implementing the method.

BACKGROUND

Micro LED (light-emitting diode) based display apparatus adopts a type of light-emitting diode device which is characterized by a much smaller size (<100 μm, about 1% of a regular LED), higher emission luminance and efficiency and lower operation power consumption comparing to organic light-emitting diode (OLED). These advantageous characteristics have made Micro LED very suitable for applications in smart phone, displayer, notebook computer, digital camera, and instrumentation that include a display functional apparatus.

Micro LED technology is a technology that shrinks the size of traditional GaN based LED and integrates a matrix of individual red, green, and blue color Micro LEDs into an array substrate. Each Micro LED acts as a single pixel unit and can be individually driven to emit light so that the display apparatus can be made to display a more delicate and contrasting image. Yet, improved pixel circuit and driving method are desired for driving each Micro LED based pixel unit to achieve better display quality.

SUMMARY

In an aspect, the present disclosure provides a pixel circuit. The pixel circuit includes a current-control circuit coupled respectively to a first data-signal terminal, a first voltage terminal, a first scan-signal terminal, and a first output node. The current-control circuit is configured to output a driving current to the first output node based on a first data signal from the first data-signal terminal and a first voltage signal from the first voltage terminal in response to a first scan signal from the first scan-signal terminal. Additionally, the pixel circuit includes a timing-control circuit coupled respectively to a second data-signal terminal, a second scan-signal terminal, multiple modulation-signal terminals, the first output node, and a second output node. The timing-control circuit is configured to select one modulation signal out of multiple modulation signals respectively from the multiple modulation-signal terminals based on a second data signal from the second data-signal terminal in response to a second scan signal from the second scan-signal terminal. Further, the timing-control circuit is configured to receive the driving current from the current-control circuit and to output the driving current via the second output node based on the modulation signal selected thereby. The second output node is coupled to a light-emitting device configured to emit light based on the driving current.

Optionally, the timing-control circuit includes a timing-data-input circuit connected to the second scan-signal terminal, the second data-signal terminal, and a first control node. The timing-data-input circuit is configured to write the second data signal to the first control node in response to the second scan signal. The timing-control circuit also includes a selection circuit connected to the first control node, the multiple modulation-signal terminals, and a first node. The selection circuit is configured to select one modulation signal out of the multiple modulation signals under control of the first control node and to write the one modulation signal selected to the first node. Additionally, the timing-control circuit includes a first storage circuit connected to the first control node and a third voltage terminal. The first storage circuit is configured to store the second data signal written from the timing-data-input circuit. Furthermore, the timing-control circuit includes a switch circuit connected to the first node, the first output node, and a third output node. The switch circuit is configured to control whether the driving current passes through the third output node in response to one modulation signal written to the first node.

Optionally, the third output node is connected to the second output node. The timing-control circuit further includes an emission-control circuit respectively connected to the third output node, the second output node, and an emission-control-signal terminal. The emission-control circuit is configured to control whether the driving current passes through the second output node in response to an emission-control signal from the emission-control-signal terminal.

Optionally, the selection circuit includes a first selection sub-circuit and a second selection sub-circuit. The multiple modulation-signal terminals include a first modulation-signal terminal and a second modulation-signal terminal. The first selection sub-circuit is connected respectively to the first control node, the first modulation-signal terminal, and the first node, and is configured to write a first modulation signal from the first modulation-signal terminal to the first node under control of the first control node. The second selection sub-circuit is connected respectively to the first control node, the second modulation-signal terminal, the first node, a fourth voltage terminal, and a fifth voltage terminal, and is configured to write a second modulation signal from the second modulation-signal terminal to the first node under control of the first control node.

Optionally, the first selection sub-circuit includes a first transistor having a gate connected to the first control node, a first terminal connected to the first modulation-signal terminal for receiving the first modulation signal, and a second terminal connected to the first node. The second selection sub-circuit includes a second transistor having a gate connected to the first control node, a first terminal connected to the first node, and a second terminal connected to the second modulation-signal terminal for receiving the second modulation signal. The first transistor and the second transistor are opposite in conduction characteristics being either P-type or N-type.

Optionally, the first selection sub-circuit includes a first transistor having a gate connected to the first control node, a first terminal connected to the first modulation-signal terminal for receiving the first modulation signal, and a second terminal connected to the first node. The second selection sub-circuit includes an inversion circuit having a first terminal connected to the first control node and a second terminal connected to a gate terminal of a third transistor, the third transistor having a first terminal connected to the first node and a second terminal connected to the second modulation-signal terminal for receiving the second modulation signal.

Optionally, the inversion circuit includes a fourth transistor and a fifth transistor. The fourth transistor has a gate terminal and a first terminal connected commonly to the fourth voltage terminal, and a second terminal connected to the gate terminal of the third transistor. The fifth transistor has a gate terminal connected to the first control node, a first terminal connected to the gate terminal of the third transistor, and a second terminal connected to the fifth voltage terminal.

Optionally, the timing-data-input circuit includes a sixth transistor having a gate terminal connected to the second scan-signal terminal for receiving a second scan signal, a first terminal connected to the second data-signal terminal for receiving the second data signal, and a second terminal connected to the first control node.

Optionally, the switch circuit includes a seventh transistor having a gate terminal coupled to the first node, a first terminal coupled to the first output node, and a second terminal coupled to the third output node.

Optionally, the first storage circuit includes a capacitor having a first terminal coupled to the first control node and a second terminal coupled to the third voltage terminal.

Optionally, the emission-control circuit includes an eighth transistor having a gate terminal coupled to the emission-control-signal terminal for receiving the emission-control signal, a first terminal coupled to the third output node, and a second terminal coupled to the second output node.

Optionally, the current-control circuit includes a display-data-input circuit connected respectively to the first data-signal terminal, the first scan-signal terminal, and a second control node. The display-data-input circuit is configured to write the first data signal to the second control node in response to the first scan signal. The current-control circuit also includes a driving circuit connected respectively to the second control node, the first voltage terminal, and the first output node. The driving circuit is configured to control a magnitude of the driving current. Additionally, the current-control circuit includes a second storage circuit connected respectively to the second control node and the first voltage terminal and configured to store the first data signal written from the display-data-input circuit.

Optionally, the display-data-input circuit includes a ninth transistor having a gate terminal connected to the first scan-signal terminal for receiving the first scan signal, a first terminal connected to the first data-signal terminal for receiving the first data signal, and a second terminal connected to the second control node. The driving circuit includes a tenth transistor having a gate terminal connected to the second control node, a first terminal connected to the first voltage terminal, and a second terminal connected to the first output node. The second storage circuit includes a second capacitor having a first terminal connected to the second control node and a second terminal connected to the first voltage terminal.

Optionally, the timing-control circuit includes a timing-data-input circuit connected respectively to the second scan-signal terminal, the second data-signal terminal, and the first control node. The timing-data-input circuit is configured to write the second data signal to the first control node in response to the second scan signal. The timing-control circuit further includes a selection circuit connected respectively to the first control node, the multiple modulation-signal terminals, and a first node. The selection circuit is configured to select one modulation signal out of the multiple modulation signals under control of the first control node and to write one modulation signal selected thereof to the first node. Additionally, the timing-control circuit includes a first storage circuit connected respectively to the first control node and a third voltage terminal. The first storage circuit is configured to store the second data signal written from the timing-data-input circuit. Furthermore, the timing-control circuit includes a switch circuit connected respectively to the first node, the first output node, and the third output node. The switch circuit is configured to control whether the driving current passes through the third output node in response to the one modulation signal written to the first node. Moreover, the second data-signal terminal and the first data-signal terminal are commonly connected to one data line for respectively receiving the second data signal and the first data signal. The first scan-signal terminal is connected to a first scan line for receiving the first scan signal. The second scan-signal terminal is connected to a second scan line for receiving the second scan signal.

Optionally, the timing-control circuit includes a timing-data-input circuit connected respectively to the second scan-signal terminal, the second data-signal terminal, and the first control node. The timing-data-input circuit is configured to write the second data signal to the first control node in response to the second scan signal. The timing-control circuit includes a selection circuit connected respectively to the first control node, the multiple modulation-signal terminals, and a first node. The selection circuit is configured to select one modulation signal out of the multiple modulation signals under control of the first control node and to write one modulation signal selected thereof to the first node. Additionally, the timing-control circuit includes a first storage circuit connected respectively to the first control node and a third voltage terminal. The first storage circuit is configured to store the second data signal written from the timing-data-input circuit. Furthermore, the timing-control circuit includes a switch circuit connected respectively to the first node, the first output node, and the third output node. The switch circuit is configured to control whether the driving current passes through the third output node in response to the one modulation signal written to the first node. The first scan-signal terminal and the second scan-signal terminal are commonly connected to one scan line for respectively receiving the first scan signal and the second scan signal. The second data-signal terminal is connected to a timing-data line for receiving the second data signal. The first data-signal terminal is connected to a display-data line for receiving the first data signal.

Optionally, the light-emitting device is a micro light-emitting diode (LED) having a length no greater than 100 μm.

In another aspect, the present disclosure provides a display panel including an array of multiple pixel units. A respective one of multiple pixel units includes a pixel circuit described herein.

Optionally, the display panel further includes multiple first scan lines, multiple second scan lines, multiple emission-control lines, multiple timing-data lines, multiple display-data lines, multiple first modulation lines, and multiple second modulation lines. The display panel further includes a scan-driving circuit, a data-driving circuit, and a modulation-signal-generation circuit. The multiple pixel units are arranged into multiple rows and columns. Pixel circuits of a same row of pixel units are respectively connected to a same one of the multiple first scan lines for receiving a first scan signal commonly. Pixel circuits of a same row of pixel units are also respectively connected to a same one of the multiple second scan lines for receiving a second scan signal commonly and respectively connected to a same one of the multiple emission-control lines for receiving an emission-control signal commonly. Pixel circuits of a same column of pixel units are respectively connected to a same one of the multiple timing-data lines for receiving a second data signal commonly, and connected to a same one of the multiple display-data lines for receiving a first data signal commonly. The pixel circuits of a same row or a same column of pixel units are respectively connected to a same one of the multiple first modulation lines for receiving a first modulation signal commonly, and connected to a same one of the multiple second modulation lines for receiving a second modulation signal commonly. The scan-driving circuit is respectively connected to the multiple first scan lines and the multiple second scan lines, and configured to supply the first scan signal and the second scan signal for the pixel circuits. The data-driving circuit is respectively connected to the multiple display-data lines and the multiple timing-data lines, and configured to supply the first data signal and the second data signal for the pixel circuits. The modulation-signal-generation circuit is respectively connected to the multiple first modulation lines and the multiple second modulation lines, and configured to supply the first modulation signal and the second modulation signal to the pixel circuits. The first scan line and the second scan line that connect with the pixel circuits of a same row of pixel units are same one scan line; or the timing-data line and the display-data line that connect with the pixel circuits of a same column of pixel units are same one data line.

In yet another aspect, the present disclosure provides a method for driving the pixel circuit described herein in one cycle of displaying a frame of image. The method includes writing a first data signal in a display-data-input period of the one cycle from the first data-signal terminal to the current-control circuit to control a magnitude of a driving current outputted to a first output node. The method further includes supplying a second data signal from the second data-signal terminal, supplying a second scan signal from the second scan-signal terminal, and supplying multiple modulation signals respectively from the multiple modulation-signal terminals in a timing-data-input period of the one cycle. Additionally, the method includes selecting one modulation signal out of the multiple modulation signals based on the second data signal under control of the second scan signal. The method further includes receiving the driving current from the first output node. Furthermore, the method includes passing the driving current in a time duration based on the one modulation signal selected thereof to output the driving current via the second output node. Moreover, the method includes emitting light based on the magnitude of the driving current in the time duration of an emission period of the one cycle.

In still another aspect, the present disclosure provides a method for driving the pixel circuit of claim 2 in one cycle of displaying a frame of image. The method includes writing a first data signal in a display-data-input period of the one cycle from the first data-signal terminal to the current-control circuit to control a driving current outputted to a first output node. Additionally, the method includes writing a second data signal from the second data-signal terminal to the first output node via the timing-data-input circuit, storing the second data signal written into a first control node by a first storage circuit, and selecting one modulation signal out of the multiple modulation signals respectively from the multiple modulation-signal terminals in a timing-data-input period of the one cycle. Furthermore, the method includes writing the one modulation signal selected thereof to a first node. The method further includes controlling whether the driving current is passed through a third output node to the second output node in response to the one modulation signal. Moreover, the method includes emitting light based on the driving current in an emission period of the one cycle.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

A basic pixel circuit used in a Micro LED display apparatus normally includes two thin-film transistors (TFTs) and one storage capacitor Cs forming a 2T1C pixel circuit to achieve a function of driving the light-emitting device, i.e., Micro LED, to emit light. The two thin-film transistors include one driving transistor and one switch transistor. For example, through a control to the thin-film transistor and storage capacitor, a driving current flown through the Micro LED can be controlled, making the Micro LED to emit light based on grayscale level of a particular pixel unit.

Figure 1:
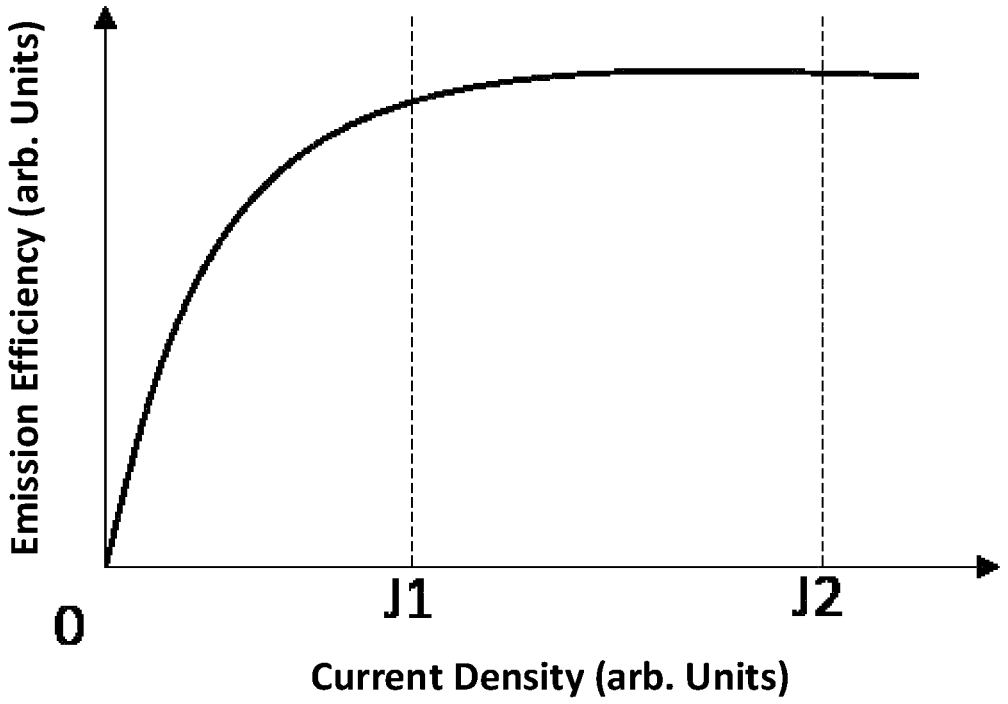
FIG. 1 is a schematic plot of emission efficiency versus current density of a Micro LED.

Micro LED is a self-emission device characterized by a typical relationship between its emission efficiency and the driving current intensity as plotted in FIG. 1. The emission efficiency of the Micro LED changes nonlinearly with changes of the driving current density. In a low current density region, the emission efficiency drops as the driving current is reduced. If the current density is used to tune grayscale, the lower grayscale levels correspond to relatively low current densities and higher grayscale levels correspond to higher current densities. Micro LED naturally has a lower emission efficiency around the low grayscale levels. Optionally, the Micro LED is set to work in a stable (with relatively high efficiency) with a corresponding current density range between J1 and J2, as shown in FIG. 1. If grayscale levels of a displayed image is adjusted only by the current density of the Micro LED, the contrast of the displayed image will be relatively limited as the current density range of J1-J2 is very limited. For example, J=0.5 $A/cm^2$, J2=12 $A/cm^2$, the contrast of the image will be 12/0.5=24. Obviously, this contrast is hardly satisfactory for most display applications.

Accordingly, the present disclosure provides, inter alia, a pixel circuit, a driving method, and a display panel having the same that substantially obviate one or more of the problems due to limitations and disadvantages of the related art. In one aspect, the present disclosure provides pixel circuit that can use both the current and emission time to control grayscale levels, enhancing image contrast and making the emitting element (i.e., Micro LED) to work with high emission efficiency for full grayscale levels.

Figure 2:
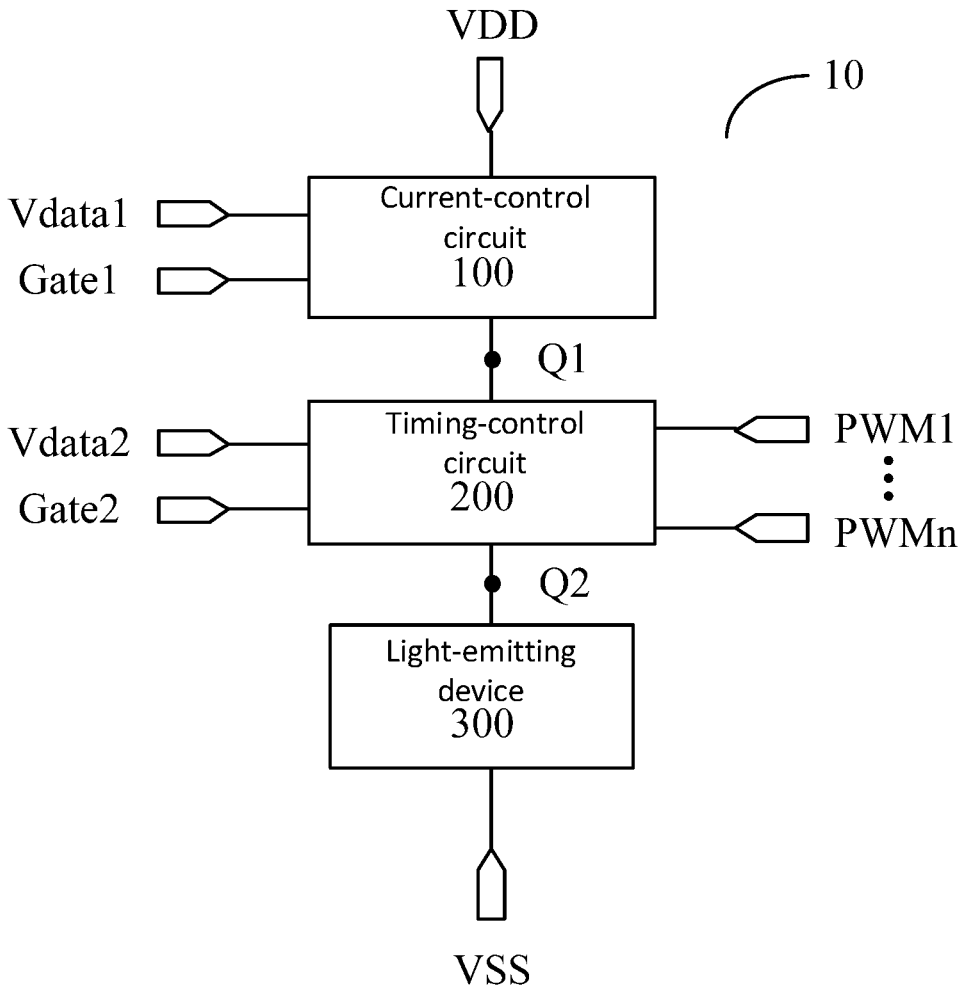
FIG. 2 is a block diagram of a pixel circuit according to some embodiments of the present disclosure.

FIG. 2 is a block diagram of a pixel circuit according to some embodiments of the present disclosure. Referring to FIG. 2, a pixel circuit 10 includes a current-control circuit 100, a timing-control circuit 200 and a light-emitting device 300. Optionally, the pixel circuit 10 is served as a subpixel or pixel in a Micro LED display apparatus.

The current-control circuit 100 is respectively coupled with a first data-signal terminal Vdata1, a first voltage terminal VDD, a first scan-signal terminal Gate1, and a first output node Q1. The current-control circuit 100 is configured to control a driving current outputted to the first output node Q1 based on a first data signal of the first data-signal terminal Vdata1 and a first voltage signal of the first voltage terminal VDD in response to a first scan signal of the first scan-signal terminal Gate1. In particular, the current-control circuit 100 is to control a current magnitude of the drive current outputted to the first output node Q1. Optionally, the first data-signal terminal Vdata1 is a display data terminal and the first data signal is a display data signal. The current-control circuit 100 in operation can provide the driving current via the first output node Q1 to the timing-control circuit 200, and further to supply the driving current to the light-emitting device 300 to drive the light-emitting device 300 to emit light based on the current magnitude of the driving current.

The timing-control circuit 200 is respectively coupled with a second data-signal terminal Vdata2, a second scan-signal terminal Gate2, multiple modulation-signal terminals PWM1~PWMn, the first output node Q1, and a second output node Q2. The timing-control circuit 200 is configured to select one modulation signal out of multiple modulation signals from the multiple modulation-signal terminals PWM1~PWMn based on a second scan signal from the second data-signal terminal Vdata2 in response to a second scan signal from the second scan-signal terminal Gate2. The timing-control circuit 200 also receives the driving current and outputs the driving current to the second output node Q2 based on the selected modulation signal. In particular, the timing-control circuit 200 is to control a time duration for the driving current to pass through the second output node Q2. Optionally, the second data-signal terminal Vdata2 is a timing data terminal and the second data signal is a timing data signal. Optionally, the timing-control circuit 200 may receive the driving current at the first output node Q1 and supply this driving current via the second output node Q2 to the light-emitting device 300, driving the light-emitting device 300 to emit light based on the magnitude of the driving current received within the time duration controlled thereof.

Optionally, the timing-control circuit 200 is operated to control a passing time of the driving current based on the selected modulation signal so that the light-emitting device 300 can receive the driving current within the passing time to drive light emission and cannot receive the driving current in other time to drive no light emission. Optionally, the number of the multiple modulation-signal terminals is not limited and can be decided based on applications. Optionally, a respective one of the multiple modulation-signal terminals corresponds to a driving current pass time. By setting up multiple modulation-signal terminals to provide multiple modulation signals, multiple selectable values can be provided for the driving current pass time which can be configured to correspond to different grayscale levels. For example, a modulation signal corresponding to a relatively short pass time can be used to define a relative low grayscale level and a modulation signal corresponding to a relatively long pass time can be used to define a relative high grayscale level. Thus, even with a narrow range of current density in J1~J2, high contrast can still be achieved, provided that different grayscale levels are not completely overlapping. Through this scheme, the tuning range of the emission time of the light-emitting device 300 is extended and the contrast of the displayed image is enhanced. Optionally, the modulation signal can be selected from different kinds of waveforms without limitation. It can be periodic pulse or can be any specific shape.

The light-emitting device 300 is respectively coupled with the second output node Q2 and a second voltage terminal VSS. The light-emitting device 300 is configured to emit light based on the magnitude of the driving current as well as the time duration to receive the driving current. For example, when the timing-control circuit 200 starts to supply the driving current from the current-control circuit 100 (the first output node Q1) to the light-emitting device 300, the light-emitting device 300 is driven to emit light based on the magnitude of the driving current. When a selected modulation signal turns off the timing-control circuit 200, the light-emitting device 300 does not emit light without receiving the driving current. Optionally, the light-emitting device 300 can be photodiode. Optionally, the light-emitting device 300 is a Micro LED.

Optionally, the current-control circuit 100, the timing-control circuit 200, and the light-emitting device 300 are all connected between the first voltage terminal VDD and the second voltage terminal VSS to provide a current path of the driving current. In the embodiment, the current-control circuit 100, the timing-control circuit 200, and the light-emitting device 300 can be connected is different sequential order between the first voltage terminal VDD and the second voltage terminal VSS, provided that a current path is provided from the first voltage terminal VDD to the second voltage terminal VSS.

Optionally, the first voltage terminal VDD is set to input a high-level DC voltage signal, which is denoted as a first voltage signal. The second voltage terminal VSS is set to input a low-level DC voltage signal, which is called a second voltage signal hereafter.

Optionally, the first data-signal terminal Vdata1 and the second data-signal Vdata2 can be connected to a same signal line and configured to respectively receive a first data signal and a second data signal at different time points, reducing number of signal lines laid in the display panel. Of course, the first data-signal terminal Vdata1 and the second data-signal Vdata2 can be connected to different signal lines so that the first data signal and the second data signal can be received by the two different data-signal terminals at a same time without interference.

Figure 3:
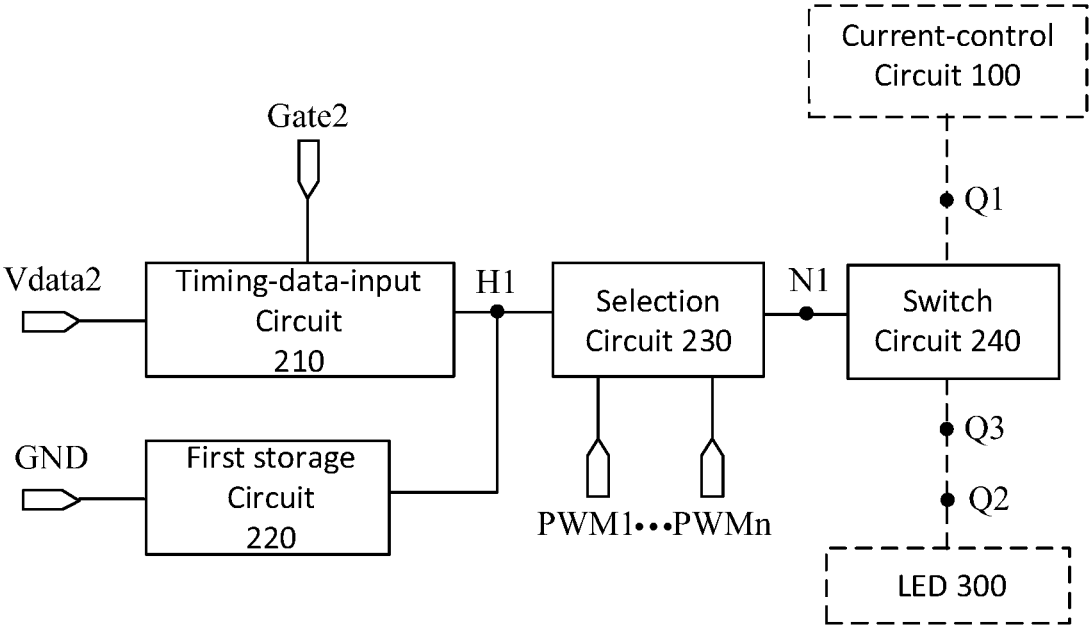
FIG. 3 is a schematic diagram of a timing-control circuit of a pixel circuit according to an embodiment of the present disclosure.

FIG. 3 is a schematic diagram of a timing-control circuit of a pixel circuit according to an embodiment of the present disclosure. Referring to FIG. 3, the timing-control circuit 200 includes a timing-data-input circuit 210, a first storage circuit 220, a selection circuit 230 and a switch circuit 240.

The timing-data-input circuit 210 is connected to the second scan-signal terminal Gate2, the second data-signal terminal Vdata2, and a first control node H1. Optionally, the timing-data-input circuit 210 is configured to write the second data signal of the second data-signal terminal Vdata2 into the first control node H1 in response to the second scan signal from the second scan-signal terminal Gate2. Optionally, the timing-data-input circuit 210 also is connected to the first storage circuit 220 to write the second data signal to the first storage circuit 220 to store the second data signal there.

The first storage circuit 220 is connected to the first control node H1 and a third voltage terminal GND, and is configured to store the second data signal written from the timing-data-input circuit 210. The third voltage terminal GND optionally is a ground terminal or a low-voltage terminal.

The selection circuit 230 is connected respectively to the first control node H1, the multiple modulation-signal terminals PWM1~PWMn, and a first node N1. The selection circuit 230 is configured to select one modulation signal out of the multiple modulation signals from the multiple modulation-signal terminals under control of the first control node H1 and to write the selected one modulation signal to the first node N1. Optionally, the selection circuit 230 is operated to select any one of the multiple modulation signals based on the second data signal written into the first control node H1 and to write the selected one modulation signal into the first node N1. The selected one modulation signal is used for controlling the switch circuit 240 to be ON or OFF in response to the selected one modulation signal.

The switch circuit 240 is coupled respectively to the first node N1, the first output node Q1, and a third output node Q3. Optionally, the third output node Q3 is directly connected to the second output node Q2. Optionally, the switch circuit 240, under control of the first node N1, is to receive the driving current from the first output node Q1 and output the driving current to the third output node Q3 for further passing the second output node Q2 and supply the driving current to the light-emitting device 300 to control its light emission.

Figure 4:
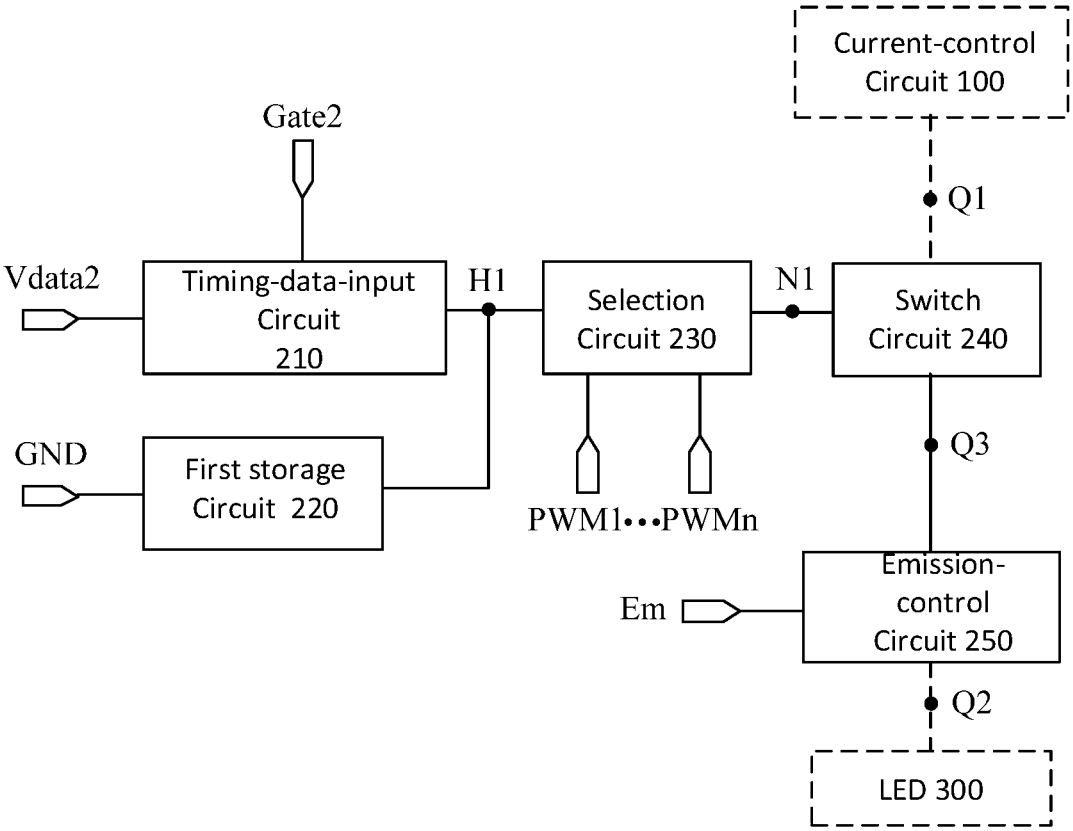
FIG. 4 is a schematic diagram of a timing-control circuit of a pixel circuit according to another embodiment of the present disclosure.

FIG. 4 is a schematic diagram of a timing-control circuit of a pixel circuit according to another embodiment of the present disclosure. Compared to the timing-control circuit 200 shown in FIG. 3, the timing-control circuit 200 in FIG. 4 also includes an emission-control circuit 250 while other part of the timing-control circuit having a substantially same circuitry structure as the timing-control circuit of FIG. 3. Optionally, the emission-control circuit 250 is respectively coupled to the third output node Q3, the second output node Q2, and an emission-control-signal terminal EM. The emission-control circuit 250 is configured to control the driving current to pass (or not) the second output node Q2 in response to an emission-control signal from the emission-control-signal terminal EM, and to control whether the light-emitting device 300 emits light or not.

Optionally, when the selection circuit 230 selects one modulation signal to write it into the first node N1 based on the second data signal written in the timing-data-input circuit 210, the modulation signal may be disturbed by noise interference. It is possible that such disturbance in the modulation signal causes the switch circuit 240 to be in an ON state at a time it should not be so that the driving current is falsely allowed to pass and cause the light-emitting device 300 to emit light at a wrong time. The emission-control circuit 250 is added aiming to prevent such unwanted event from happening to provide a stable control of the driving current.

Figure 5:
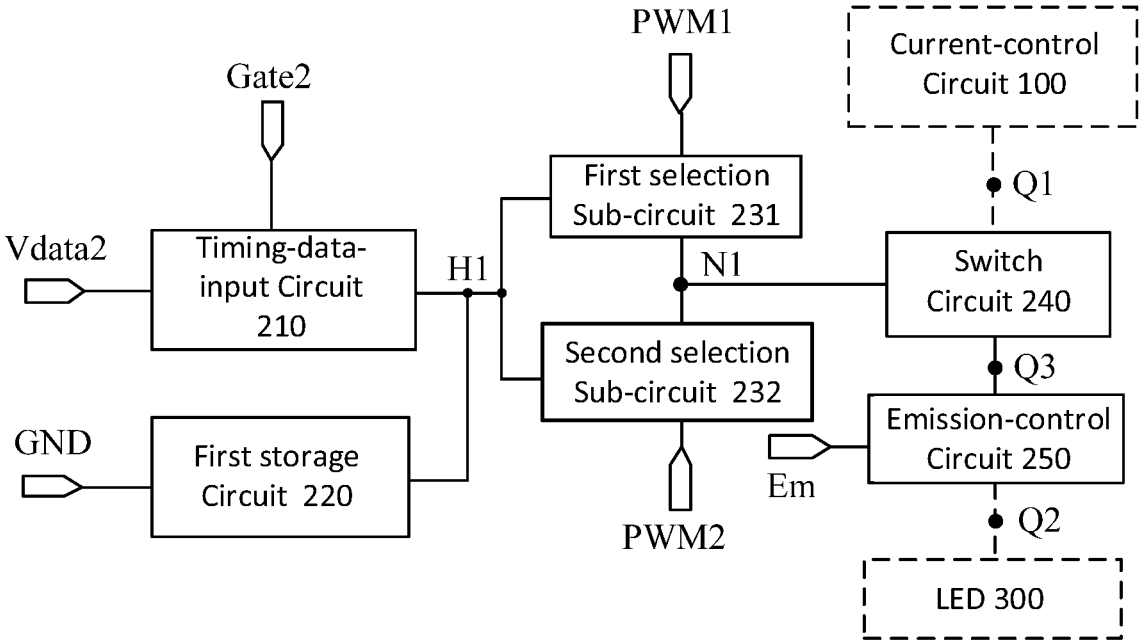
FIG. 5 is a schematic diagram of a timing-control circuit of a pixel circuit according to yet another embodiment of the present disclosure.

FIG. 5 is a schematic diagram of a timing-control circuit of a pixel circuit according to yet another embodiment of the present disclosure. Comparing to the timing-control circuit 200 shown in FIG. 4, the selection circuit 230 in this embodiment of FIG. 5 includes multiple sub-circuits for respectively selecting multiple modulation signals. Optionally, the selection circuit 230 includes a first selection sub-circuit 231 and a second selection sub-circuit 232. Correspondingly, multiple modulation-signal terminals have a first modulation-signal terminal PWM1 and a second modulation-signal terminal PWM2. Hereafter, each of PWM1 and PWM2 is referred to either a modulation signal or a corresponding terminal.

Referring to FIG. 5, the first selection sub-circuit 231 is respectively coupled with the first control node H1, the first modulation-signal terminal PWM1, and the first node N1, and is configured to write the first modulation signal from the first modulation-signal terminal PWM1 to the first node N1 under control of the first control node H1. The second selection sub-circuit 232 is respectively coupled with the first control node H1, the second modulation-signal terminal PWM2, and the first node N1, and is configured to write the second modulation signal from the second modulation-signal terminal PWM2 to the first node N1 under control of the first control node H1. Optionally, the second selection sub-circuit 232 also is connected to a fourth voltage terminal and a fifth voltage terminal (not shown). Optionally, at a same time, one of the first selection sub-circuit 231 and the second selection sub-circuit 232 is opened in response to the second data signal written into the first control node H1 and to write one of the first modulation signal PWM1 and the second modulation signal PWM2 to the first node N1. Then, either PWM1 or PWM2 written into the first node N1 can control the switch circuit 240 to open (ON) or close (OFF).

No limit is imposed to the number of multiple selection sub-circuits in the selection circuit, depending on applications. The number of multiple selection sub-circuits is one to one correspondence with the number of multiple modulation-signal terminals. At any time, only one selection sub-circuit is opened in response to the second data signal so that one modulation signal from a corresponding modulation-signal terminal is written into the first node N1. Optionally, the first selection sub-circuit 231 and the second selection sub-circuit 232 can achieve their functions by adopting transistors with opposite conduction types. For example, the first selection sub-circuit 231 uses P-type transistors and the second selection sub-circuit 232 uses N-type transistors, or vice versa.

Figure 6:
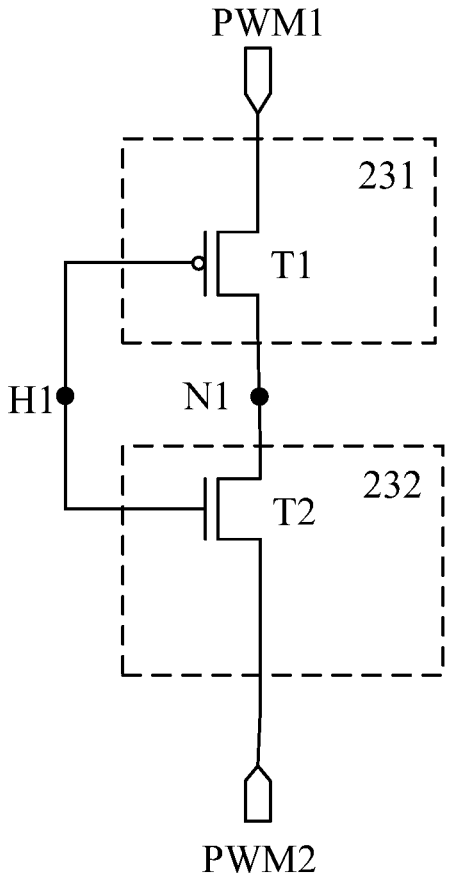
FIG. 6 is a circuit diagram of a selection circuit of a pixel circuit according to an embodiment of the present disclosure.

FIG. 6 is a circuit diagram of a selection circuit of a pixel circuit according to an embodiment of the present disclosure. Referring to FIG. 6, in a specific embodiment, the first selection sub-circuit 231 includes a first transistor T1. Optionally, the first transistor T1 is a P-type transistor. In the embodiment, the second selection sub-circuit 232 includes a second transistor T2. Optionally, the second transistor T2 is an N-type transistor. A gate electrode of the first transistor T1 is connected to the first control node H1. A first electrode of the first transistor T1 is connected to the first modulation-signal terminal PWM1 for receiving the first modulation signal. A second electrode of the first transistor T1 is connected to the first node N1. A gate electrode of the second transistor T2 is connected to the first control node H1 (e.g., the gate electrode of the first transistor T1). A first electrode of the second transistor T2 is connected to the first node N1. A second electrode of the second transistor T2 is connected to the second modulation-signal terminal PWM2 for receiving the second modulation signal.

When the first control node H1 is at a low voltage level, the gate electrode of the first transistor T1 is at the low voltage level so that the first transistor T1 is turned on and the first modulation signal from the first modulation-signal terminal PWM1 is written into the first node N1. At this time, the gate electrode of the second transistor T2 is also at the low voltage level to make the second transistor T2 to be turned off. When the first control node H1 is in a high voltage level, the gate electrode of the first transistor T1 is at the high voltage level to turn off the first transistor T1. At this time, the gate electrode of the second transistor T2 is also at the high voltage level to turn on the second transistor T2 and to write the second modulation signal from the second modulation-signal terminal PWM2 to the first node N1. Thus, the selection of the first modulation signal and the second modulation signal is achieved by this circuit.

Figure 7:
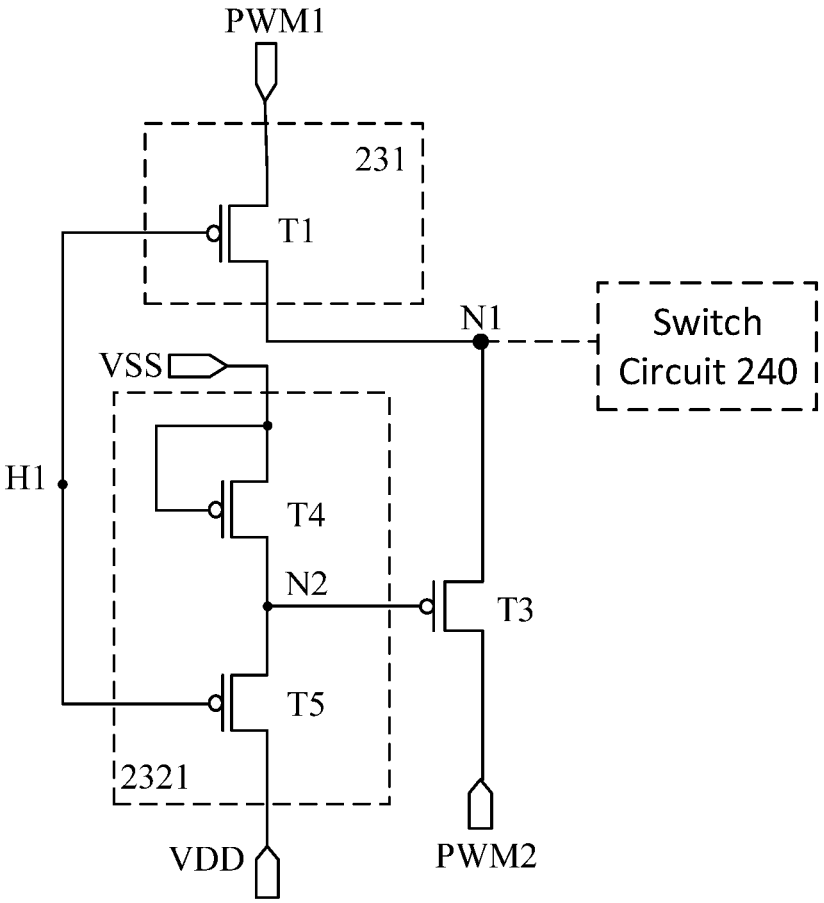
FIG. 7 is a circuit diagram of a selection circuit of a pixel circuit according to another embodiment of the present disclosure.

Alternatively, the first transistor T1 can be set to be an N-type transistor while the second transistor T2 is set a P-type transistor. Alternatively, FIG. 7 shows a circuit diagram of a selection circuit of a pixel circuit according to another embodiment of the present disclosure. As shown in FIG. 7, the first selection sub-circuit 231 includes a first transistor T1, a second selection sub-circuit 232 includes an inversion circuit 2321 and a third transistor T3. The inversion circuit 2321 includes a fourth transistor T4 and a fifth transistor T5.

Referring to FIG. 7, the first transistor T1 has a gate electrode coupled to the first node H1, a first electrode coupled to the first modulation-signal terminal PWM1 to receive the first modulation signal, and a second electrode coupled to the first node N1. The third transistor T3 has a first electrode coupled to the first node N1 and a second electrode coupled to the second modulation-signal terminal PWM2 to receive the second modulation signal. The inversion circuit 2321 is connected between the first control node H1 and a gate electrode (which is also connected to the second node N2) of the third transistor T3. Optionally, the fourth transistor T4 has a gate electrode and a first electrode connected to each other and is configured to connect with the fourth voltage terminal to receive a fourth voltage signal (here the second voltage terminal VSS is the fourth voltage terminal and the second voltage signal is the fourth voltage signal). A second electrode of the fourth transistor T4 is connected to the gate electrode of the third transistor T3. A gate electrode of the fifth transistor T5 is connected to the first control node H1 (i.e., the gate electrode of the first transistor T1). A first electrode of the fifth transistor T5 is connected to the gate electrode of the third transistor T3. A second electrode of the fifth transistor T5 is connected to the fifth voltage terminal to receive a fifth voltage signal (here, the first voltage terminal VDD is the fifth voltage terminal, and the first voltage signal is the fifth voltage signal). Optionally, the first transistor T1, the third transistor T3, the fourth transistor T4, and fifth transistor T5 are all the same type of transistors (FIG. 7 uses P-type transistor as an illustration example. Alternatively, N-type transistors can be used).

When the first control node H1 is at a high voltage level, the gate electrode of the first transistor T1 is at the high voltage level to turn the first transistor T1 OFF. The gate electrode of the fifth transistor T5 is also at the high voltage level to turn off the fifth transistor T5. Under a low voltage supplied to the second voltage terminal, the fourth transistor T4 is turned ON to make the gate electrode of the third transistor T3 at the low voltage level and to turn the third transistor T3 ON. Thus, the second modulation signal from the second modulation-signal terminal PWM2 is written into the first node N1 to allow the second modulation signal to control the switch circuit 240 ON or OFF. When the first control node H1 is at a low voltage level, the gate electrode of the first transistor T1 is at the low voltage level to turn the first transistor T1 ON and write the first modulation signal from the first modulation-signal terminal PWM1 to the first node N1. Thus, the first modulation signal is able to control the switch circuit 240 ON or OFF. At this time, the fifth transistor T5 and the fourth transistor T4 are also turned ON. By designing proper channel width-to-length ratio of the fifth transistor T5 and the fourth transistor T4, the first electrode (which is also connected to the second node N2 and the gate electrode of the third transistor T3) of the fifth transistor T5 can be set to the high voltage level so that the third transistor T3 is turned OFF and the second modulation signal from the second modulation-signal terminal PWM2 will not be written into the first node N1. Through this circuit scheme, the selection of the first modulation signal and the second modulation signal can be achieved. All transistors can be chosen to be the same type to simplify the process (e.g., a same PMOS process can be used).

Figure 8:
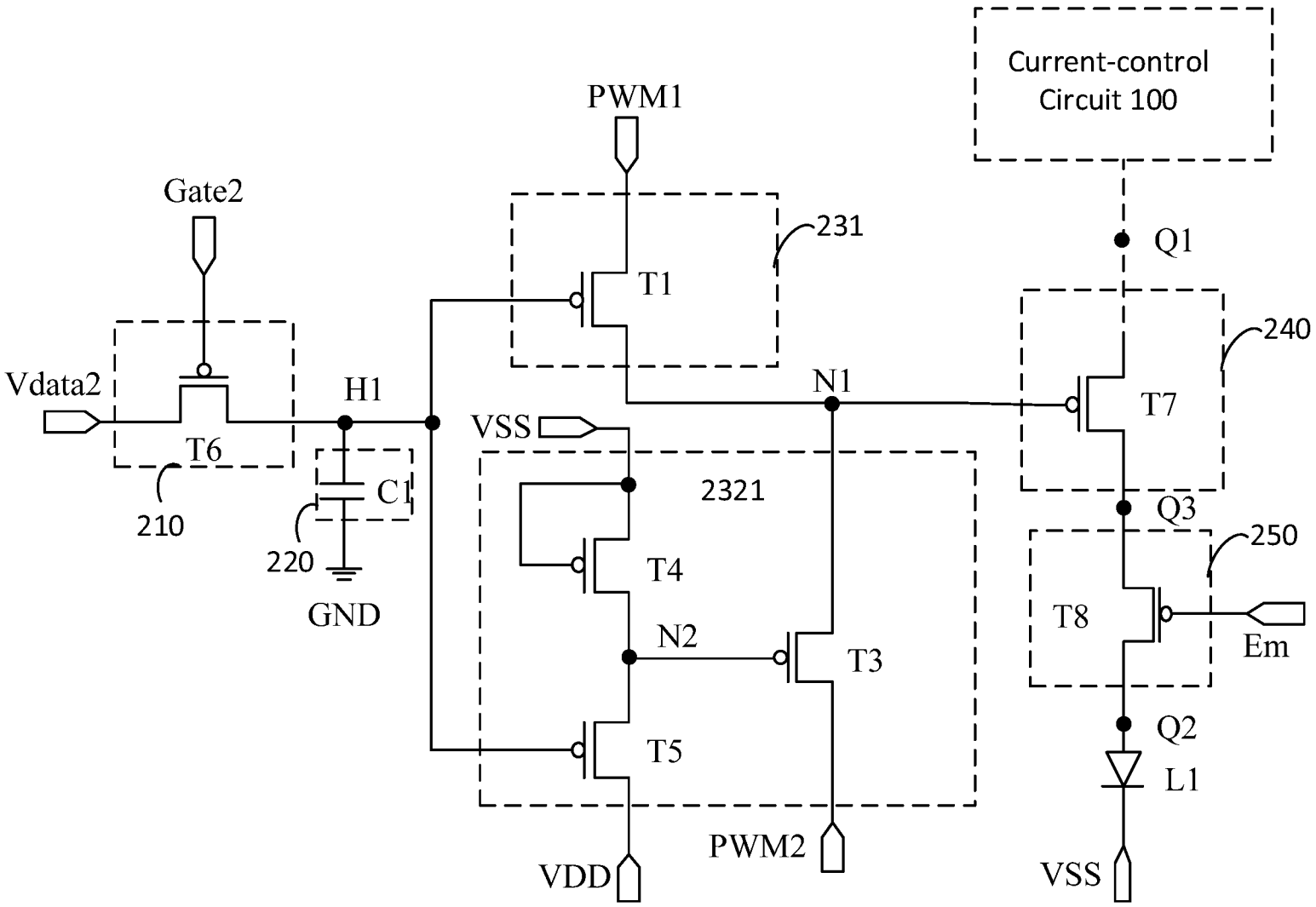
FIG. 8 is a circuit diagram of a timing-control circuit of the pixel circuit of FIG. 5 according to an embodiment of the present disclosure.

FIG. 8 is a circuit diagram of a timing-control circuit of the pixel circuit of FIG. 5 according to an embodiment of the present disclosure. Referring to FIG. 8, the selection circuit is substantially configured the same way as that in FIG. 7, including a first selection sub-circuit 231 (i.e., the first transistor T1), an inversion circuit 2321, and a third transistor T3. Additionally in the embodiment, the timing-data-input circuit 210 in a timing-control circuit 200 is configured to be a sixth transistor T6. The sixth transistor T6 has a gate electrode coupled to the second scan-signal terminal Gate2 to receive the second scan signal, a first electrode coupled to the second data-signal terminal Vdata2 to receive the second data signal, and a second electrode coupled to the first control node H1.

Referring to FIG. 8, the first storage circuit 220 is a first capacitor C1 having a first electrode coupled to the first control node H1 and a second electrode coupled to the third voltage terminal GND to receive a third voltage signal. Optionally, the third voltage terminal GND is grounded. Optionally, the second voltage terminal VSS or other low-voltage terminals can be used as the third voltage terminal GND. The switch circuit 240 is a seventh transistor T7 having a gate electrode coupled to the first node N1, a first electrode coupled to the first output node Q1, and a second electrode coupled to the third output node Q3. The emission-control circuit 250 is an eighth transistor T8 having a gate electrode coupled to the emission-control terminal Em to receive an emission-control signal, a first electrode coupled to the third output node Q3 (which is also connected to the second electrode of the seventh transistor T7), and a second electrode coupled to the second output node Q2 which is also connected to an anode of a light-emitting device L1. Here the light-emitting device L1 optionally is a Micro LED.

Figure 9:
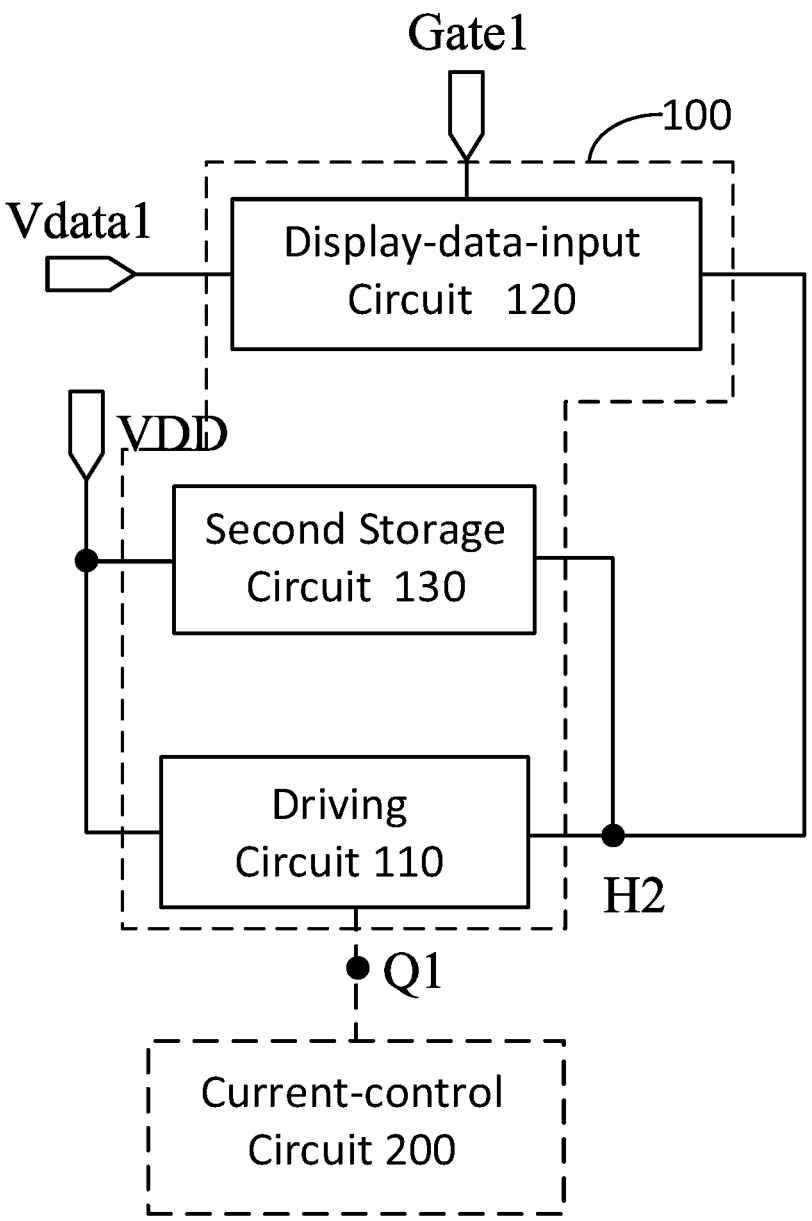
FIG. 9 is a schematic diagram of a current-control circuit of a pixel circuit according to an embodiment of the present disclosure.

FIG. 9 is a schematic diagram of a current-control circuit of a pixel circuit according to an embodiment of the present disclosure. Referring to FIG. 9, the current-control circuit 100 (as shown in all earlier figures) includes a driving circuit 110, a display-data-input circuit 120, and a second storage circuit 130. The driving circuit 110 is connected to a second control node H2, the first voltage terminal VDD, and the first output node Q1, and is configured to control a magnitude of the driving current. The display-data-input circuit 120 is connected to the first data-signal terminal Vdata1, the first scan-signal terminal Gate1, and the second control node H2. The display-data-input circuit 120 is configured to write the first data signal from the first data-signal terminal Vdata1 to the second control node H2 in response to the first scan signal from the first scan-signal terminal Gate1. The second storage circuit 130 is connected to the second control node H2 and the first voltage terminal VDD and is configured to store the first data signal written into the second control node H2 by the display-data-input circuit 120.

Figure 10:
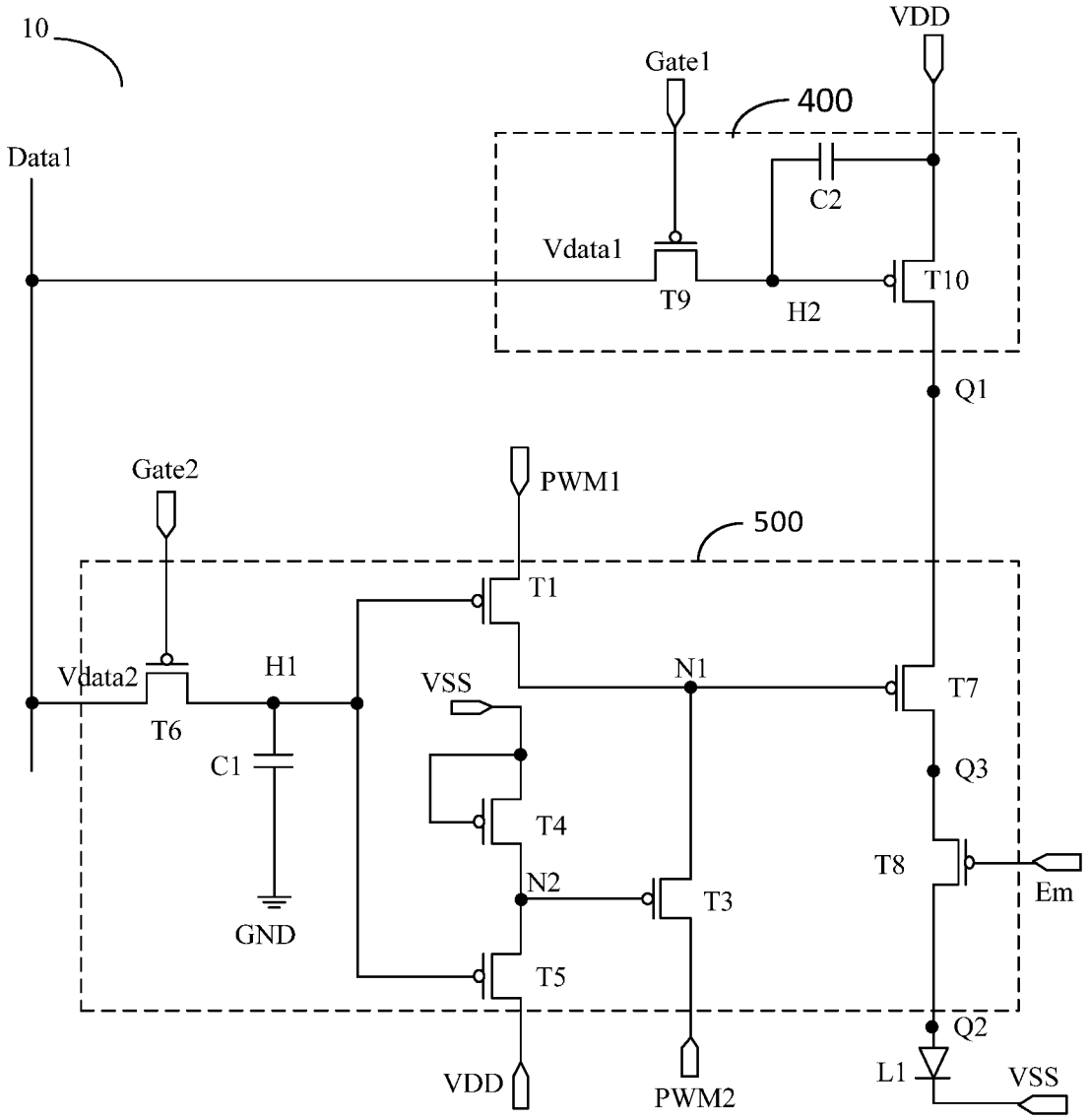
FIG. 10 is a circuit diagram of a pixel circuit according to a specific embodiment of the present disclosure.

FIG. 10 is a circuit diagram of a pixel circuit according to a specific embodiment of the present disclosure. Referring to FIG. 10, pixel circuit 10 includes a first transistor T1, a third through tenth transistors T3~T10, a first capacitor C1, a second capacitor C2, and a light-emitting device L1. The ninth transistor T9, the tenth transistor T10, and the second capacitor forms a current-control circuit 400 substantially the same as the current-control circuit 100 of FIG. 9. The first transistor T1, the third through eighth transistors T3~T8, and the first capacitor C1 of the FIG. 10 forms a timing-control circuit 500 substantially the same as the timing-control circuit 200 of FIG. 9.

Referring to FIG. 10, the driving circuit 110 of FIG. 9 is constructed as a tenth transistor T10. Optionally, agate electrode of the tenth transistor T10 is connected to the second control node H2. A first electrode of the tenth transistor T10 is connected to the first voltage terminal VDD. A second electrode of the tenth transistor T10 is connected to a first electrode of the seventh transistor T7 (which is also the first output node Q1). Optionally, the driving circuit 110 includes two sets of driving transistors that can be switched back and forth depending on situation.

The display-data-input circuit 120 of FIG. 9 is constructed as a ninth transistor T9. Optionally, a gate electrode of the ninth transistor T9 is connected to the first scan-signal terminal Gate1 to receive the first scan signal. A first electrode of the ninth transistor T9 is connected to the first data-signal terminal Vdata1 to receive the first data signal. A second electrode of the ninth transistor T9 is connected to the second control node H2 or the gate electrode of the tenth transistor T10.

The second storage circuit 130 of FIG. 9 is constructed as the second capacitor C2 having a first electrode coupled to the second control node H2 and a second electrode coupled to the first voltage terminal VDD to receive the first voltage signal. Optionally, the second electrode of the second capacitor C2 and the first electrode of the tenth transistor T10 are commonly connected to the first voltage terminal VDD, reducing the number of signal lines in the display panel. Optionally, the second electrode of the second capacitor C2 is connected to other high-voltage terminals independent from the first voltage terminal VDD to prevent voltage variation at the first voltage terminal VDD from affecting the first data signal stored in the second capacitor C2, making the first data signal more accurate. Alternatively, the second storage circuit 130 can be constructed as two capacitors coupled in series or in parallel.

Optionally, the light-emitting device L1 is a Micro LED. A first terminal (an anode) of the light-emitting device L1 is connected to the second output node Q2 which is also the second electrode of the eighth transistor T8. A second terminal (a cathode) of the light-emitting device L1 is connected to the second voltage terminal VSS to receive the second voltage signal. In an example, in a display panel when all pixel circuits 10 are arranged in a matrix array, the cathode of the light-emitting device L1 in a respective one pixel circuit can be connected commonly to a same voltage terminal, i.e., in a common-cathode connection scheme.

Referring to FIG. 10 again, the sixth transistor T6 in the timing-control circuit 500 includes a first electrode connected to a first electrode of the ninth transistor T9 in the current-control circuit 400. Both of the first electrode of T6 in the timing-control circuit 500 and the first electrode of T9 in the current-control circuit 400 can be connected to a single data line Data1 for respectively receiving a second data signal and a first data signal at different times. A gate electrode of the sixth transistor T6 is connected to the second scan-signal terminal Gate2 to receive the second scan signal. A gate electrode of the ninth transistor T9 is connected to the first scan-signal terminal Gate1 to receive the first scan signal. The first scan-signal terminal Gate1 and the second scan-signal terminal Gate2 are connected separately to different signal lines. It is preferred to achieve functions of writing in the first data signal as well as writing in the second data signal while reducing the number of signal lines for simplifying line layout and adopting a narrow-border for the display panel.

Figure 11:
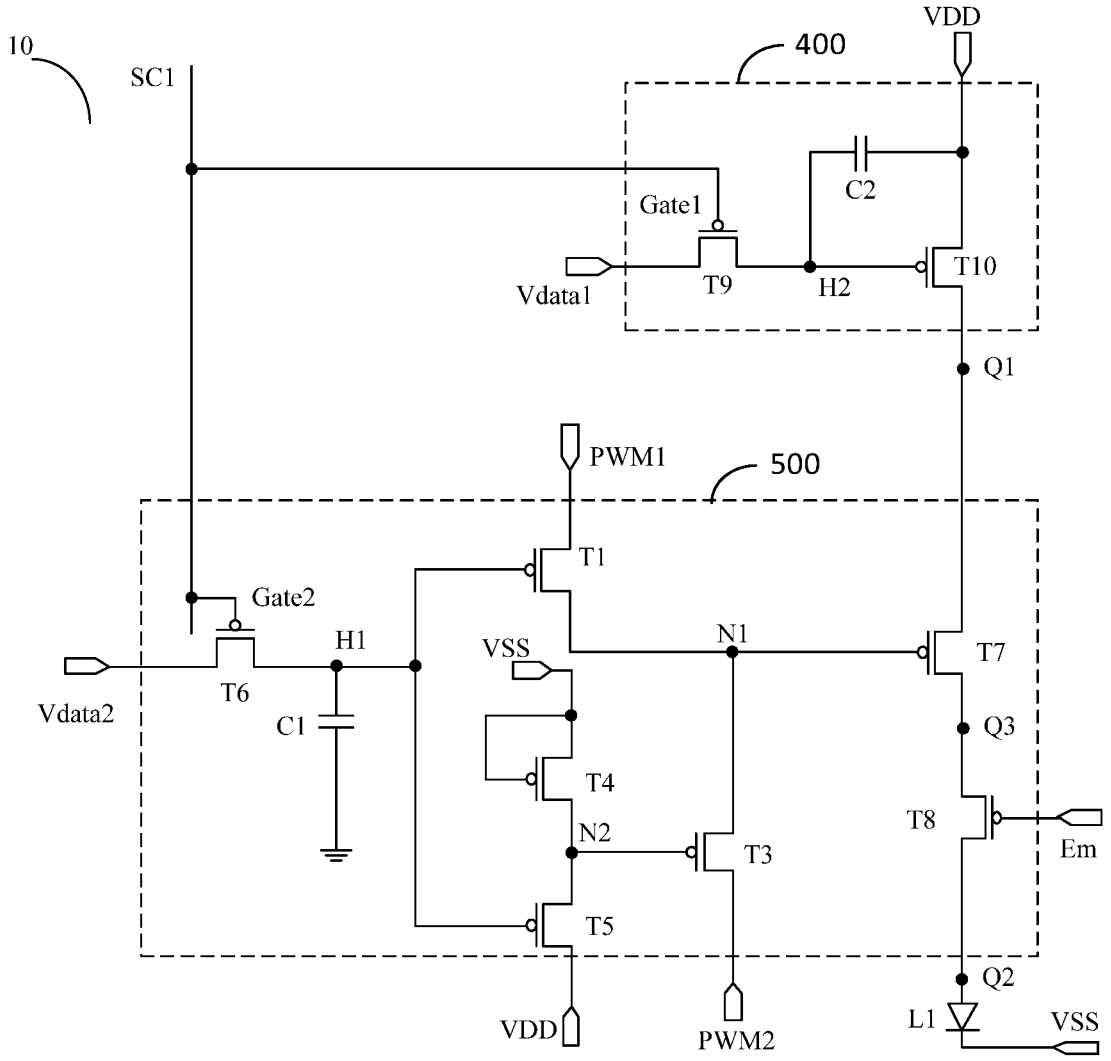
FIG. 11 is a circuit diagram of a pixel circuit according to another specific embodiment of the present disclosure.

FIG. 11 is a circuit diagram of a pixel circuit according to another specific embodiment of the present disclosure. Referring to FIG. 11, a pixel circuit 10 is provided including a first transistor T1, a third through tenth transistors T3~T10, a first capacitor C1, a second capacitor C2, and a light-emitting device L1, substantially similar to a circuitry structure of pixel circuit 10 shown in FIG. 10. Unlike the circuitry structure of FIG. 10, the gate electrode of the sixth transistor T6 in the timing-control circuit 500 and the gate electrode of the ninth transistor T9 in the current-control circuit 400 can be connected commonly to a same scan line SC so that they can respectively receive the first scan signal and the second scan signal at different times. In this case, the first electrode of T6 is connected to the second data-signal terminal Vdata2 to receive the second data signal and the first electrode of T9 is connected to the first data-signal terminal Vdata1 to receive the first data signal. Additionally, the first data-signal terminal Vdata1 and the second data-signal terminal Vdata2 are separately connected to different signal lines. It is preferred to achieve functions of writing in the first data signal as well as writing in the second data signal while reducing the number of signal lines for simplifying line layout and adopting a narrow-border for the display panel.

Alternatively, each of the first scan-signal terminal Gate1, the second scan-signal terminal Gate2, the first data-signal terminal Vdata1, and the second data-signal terminal Vdata2 can be connected to a different signal line so that the process will not be depended on specific timing sequence of loading a specific signal. Instead, the timing data input process and the first data signal input process can be executed at the same time to enhance the line-by-line scanning speed of the display panel that incorporates the pixel circuit 10 therein.

In the embodiment, the current-control circuit 100 and the light-emitting device 300 forms a basic 2T1C pixel circuitry structure through the ninth transistor T9, the tenth transistor T10 and the second capacitor C2 to achieve a function of controlling a magnitude of the driving current flown through the light-emitting device L1. In some embodiments, the current-control circuit 100 and the light-emitting device 300 in the pixel circuit 10 can be configured to various other circuitry structures such as 4T1C, 4T2C circuits that contain compensation function or others. Accordingly, the timing-control circuit 200 does not have a specific limitation on the transistor(s)(e.g., the seventh transistor T7 and the eighth transistor T8) used for providing a path of the driving current and the order of connecting with the driving transistor and light emitting device in the so called 2T1C, or 4T1C, or 4T2C circuits. Optionally, all the transistors used in the circuits described herein can be made by thin-film transistors, or field-effect transistors, or other switch devices functioned the same. Here, the thin-film transistor is used as an example in these circuits, which has a symmetric structure for its drain and source. Thus, for each transistor, the first electrode and the second electrode can be either a source or drain without affecting the results described herein or related claims herein. Also, the transistor can be either P-type or N-type, while P-type transistors are used as an example for all embodiments described herein. In some specific embodiments, the N-type transistor can be provided with an active layer based on Indium Gallium Zinc Oxide (IGZO). This type active layer has advantage of being made in small size to prevent leakage, comparing with other active layers using Low Temperature Poly Silicon (LTPS) or amorphous silicon (such as oxide amorphous silicon) material. The P-type transistor can be provided with an active layer based on LTPS or amorphous silicon material.

Figure 12:
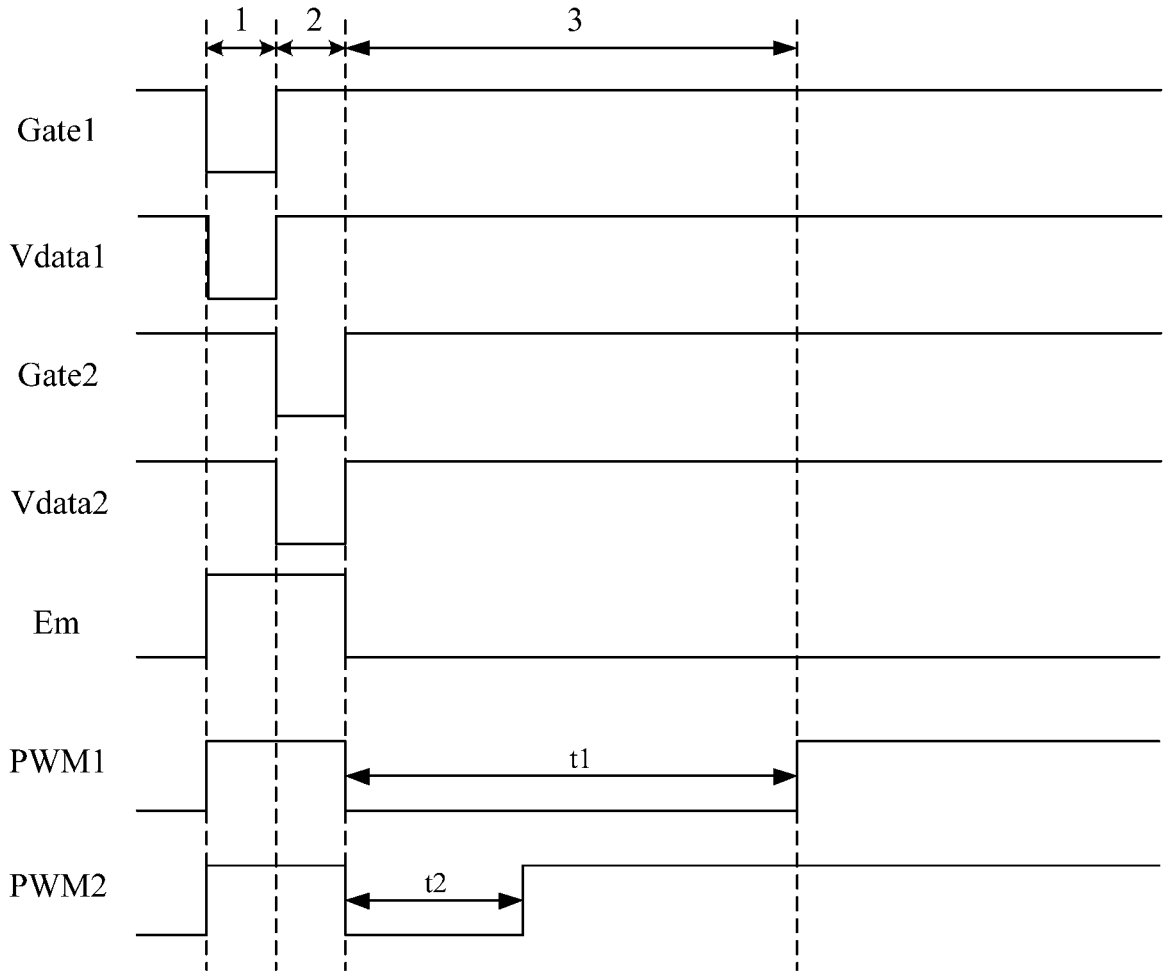
FIG. 12 is a timing waveform diagram of a pixel circuit according to an embodiment of the present disclosure.

FIG. 12 is a timing waveform diagram of a pixel circuit according to an embodiment of the present disclosure. The pixel circuit here can be one shown in FIG. 10 or FIG. 11, specifically, each of the first scan-signal terminal Gate1, the second scan-signal terminal Gate2, the first data-signal terminal Vdata1, and the second data-signal terminal Vdata2 are respectively connected to four different signal lines for receiving the first scan signal, the second scan signal, the first data signal, and the second data signal. The pixel circuit is operated in three periods sequentially marked as 1, 2, and 3.

Referring to FIG. 12, in a first period 1, the first scan-signal terminal Gate1 supplies a low voltage signal, turning the ninth transistor T9 ON. The first data-signal terminal Vdata1 supplies a low voltage signal, the ninth transistor T9 allows the low voltage of the first data signal be written into the gate electrode of the tenth transistor T10 and stored in the second capacitor C2. The tenth transistor T10 is turned ON. At this time, the emission-control-signal terminal Em supplies a high voltage signal, turning off the eighth transistor T8 so that the light-emitting device L1 does not emit light in the first period.

In a second period 2, the second scan-signal terminal Gate2 supplies a low voltage signal, the sixth transistor T6 is turned ON. The second data-signal terminal Vdata2 supplies a low voltage signal (as shown in FIG. 12) or a high voltage signal as the second data signal. The sixth transistor T6 allows the second data signal be written to the gate electrode of the first transistor T1 and the gate electrode of the fifth transistor T5, and stored in the first capacitor C1. In an example, the second data signal is a low voltage signal, the first transistor T1 is turned ON to write the first modulation signal from the first modulation-signal terminal PWM1 into the first node N1. At this time, the fifth transistor T5 and the fourth transistor T4 are turned ON and the second node N2 is at a high voltage level, so that the third transistor T3 is turned OFF. In another example, the second data signal is a high voltage signal, the first transistor T1 is turned OFF. At this time, the fifth transistor is turned OFF and the fourth transistor T4 is turned ON. The second node N2 is at a low voltage level, so that the third transistor T3 is turned ON to write the second modulation signal from the second modulation-signal terminal PWM2 to the first node N1. Since both the first modulation signal and the second modulation signal are high voltage signal, the seventh transistor T7 is turned OFF. The eighth transistor T8 is kept in OFF state and the light-emitting device L1 does not emit light in the second period.

In a third period 3, the emission-control-signal terminal Em supplies a low voltage signal, turning the eighth transistor T8 ON. The seventh transistor T7 is turned ON based on the first modulation signal PWM1 or the second modulation signal PWM2 written into the first node N1. Additionally, the time duration of the seventh transistor T7 in the ON state equals to a low-voltage pulse width of the first modulation signal PWM1 or the second modulation signal PWM2. The tenth transistor T10 is kept in ON state. Since the tenth transistor T10, the seventh transistor T7, the eighth transistor T5, and the light-emitting device L1 together form a current path from the first voltage terminal VDD to the second voltage terminal VSS, the light-emitting device L1 will be driven by the driving current to emit light in the third period.

For example, the first modulation signal PWM1 in the third period 3 has a low-voltage pulse width (i.e., a time duration of the signal at the low voltage level) of t1. The second modulation signal PWM2 in the third period 3 has a low-voltage pulse width of t2. t1≠t2. The emission time of light-emitting device L1 can be selected to t1 or t2 based on the second data signal to achieve different grayscale level. At this time, the magnitude of the driving current is determined by the first data signal Vdata1 written in during the first period 1, the emission time is determined by the first modulation signal PWM1 or the second modulation signal PWM2 written into the first node N1 during the second period 2. Optionally, the low-voltage pulse width of the first modulation signal PWM1 or the second modulation signal PWM2 (i.e., a length of t1 or t2) can be tuned to flexibly adjust the emission time of the light-emitting device L1 depending on requirement. In this way, full grayscale level display can be realized to keep the light-emitting device L1 worked in a relatively high-efficiency region while to only flexibly adjust a length of t1 and t2, making this pixel circuit suitable for all kinds of light-emitting devices.

For example, the driving current I& flown through the light-emitting device L1 can be expressed in a formula shown below:

$$I_{ds}=K(V_{gs}-V_{th})^2=K(\text{Vdata1}-VDD-V_{th})^2$$

In this formula, V& represents a threshold voltage of the tenth transistor T10. $V_{gs}$ represents a gate-to-source voltage of the tenth transistor T10. K is a constant associated with intrinsic property of the tenth transistor T10.

Figure 13:
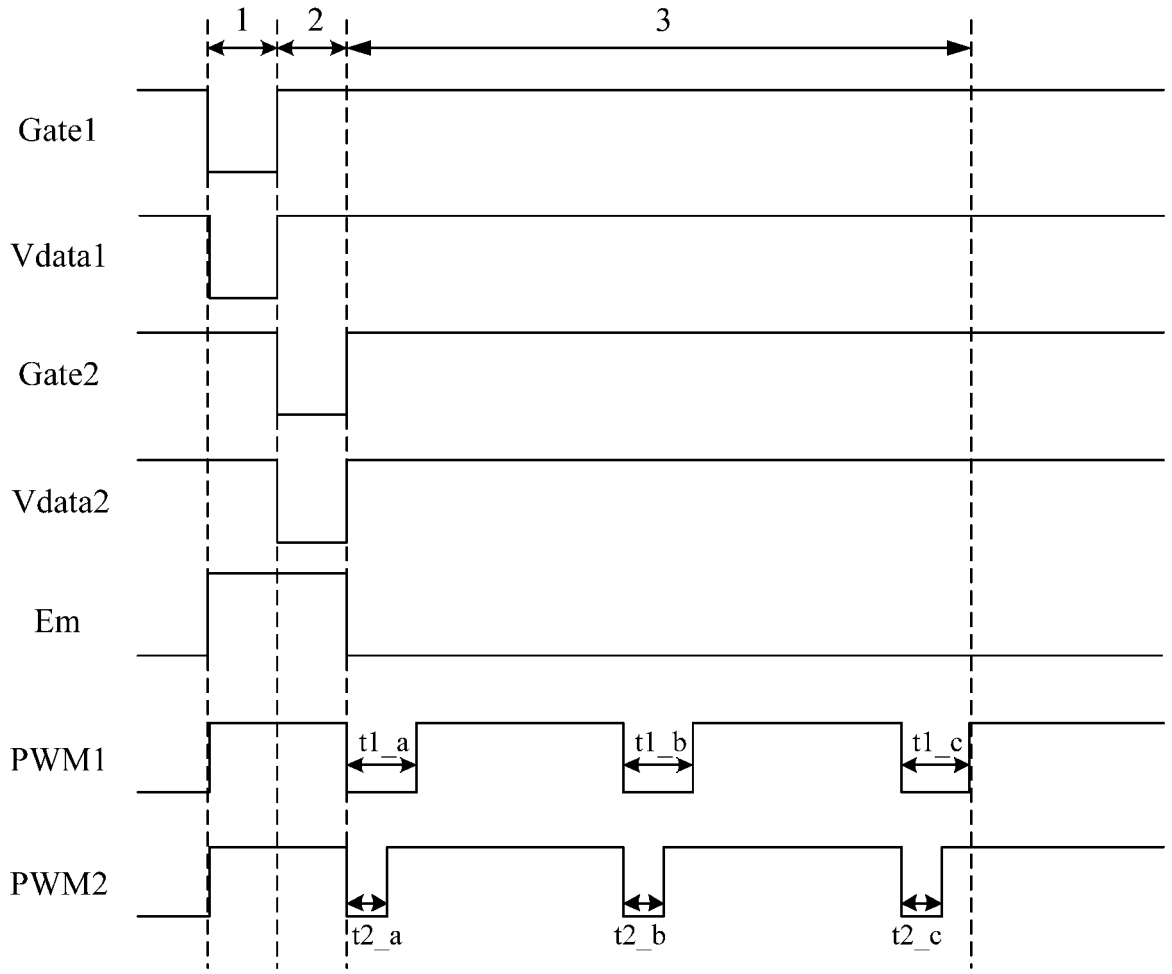
FIG. 13 is a timing waveform diagram of a pixel circuit according to another embodiment of the present disclosure.

FIG. 13 is a timing waveform diagram of a pixel circuit according to another embodiment of the present disclosure. Comparing with FIG. 12, the first modulation signal PWM1 and the second modulation signal PWM2 in the third period 3 are provided as periodic pulses. In the first period 1 and the second period 2, operation of the pixel circuit 10 can be referenced to the signal timing waveform in the first period 1 and the second period 2 shown in FIG. 12.

In the third period 3 of FIG. 13, the seventh transistor T7 is turned ON when the first modulation signal PWM1 or the second modulation signal PWM2 is a low voltage signal. Or T7 is turned OFF when PWM1 or PWM2 is a high voltage signal. Since the tenth transistor T10 and the eighth transistor T8 are kept at ON state. The light-emitting device L1 will emit light when the seventh transistor T7 is turned ON and will not emit light when the seventh transistor T7 is turned OFF. Optionally, when the first modulation signal PWM1 is written into the first node N1, a total emission time of the light-emitting device L1 during the third period 3 is t1. Optionally, t1=t1_a+t1_b+t1_c. t1_a, t1_b, and t1_c respectively represent multiple low-voltage pulse-width of the first modulation signal PWM1 in the third period 3. Optionally, when the second modulation signal PWM2 is written into the first node N1, a total emission time of the light-emitting device L1 during the third period 3 is t2. Optionally, t2=t2_a+t2_b+t2_c. t2_a, t2_b, and t2_c respectively represent multiple low-voltage pulse-width of the first modulation signal PWM2 in the third period 3. T1 or t2 is a cumulated low-voltage pulse width of the first modulation signal PWM1 or the second modulation signal PWM2 in the third period 3 no matter what kinds of signal waveforms each of these signals has.

In an example, the light-emitting device L1 is a Micro LED, working at a relative high emission efficiency in a current density region of J1~J2. The Micro LED has an emission luminance that may be 10 times brighter than a highest required level for display. Therefore, a duty cycle (i.e., a ratio of t1 over one frame of emission time) of the first modulation signal PWM1 can be set to 1/10 so that the emission luminance of the Micro LED under the highest current density J2 is substantially equal to the highest required level. In this way, when the first modulation signal PWM1 is written into the first node N1, a ratio of the highest level displayable over the lowest level is 12/0.5=24. Additionally, different levels below 1/24 of the highest level can be realized through the second modulation signal PWM2. For example, a duty cycle (i.e., a ratio of t2 over one frame of emission time) of the second modulation signal PWM2 is set to 1/240. Under this scheme, a display contrast (a ratio of the highest level over the lowest level) can achieve (12/10):(0.5/240)=576:1. This display contrast would be a satisfactory one for general display applications.

In another aspect, the present disclosure provides a display panel including an array of multiple pixel units. A respective one of the multiple pixel units includes a pixel circuit described herein. The display panel can control its display grayscale levels by using both magnitude of driving current and emission time, advantageously enhancing display contrast and making the light-emitting device (e.g., Micro LED) in a respective one pixel circuit to work in relative high-efficiency region for full grayscale levels.

Figure 14:
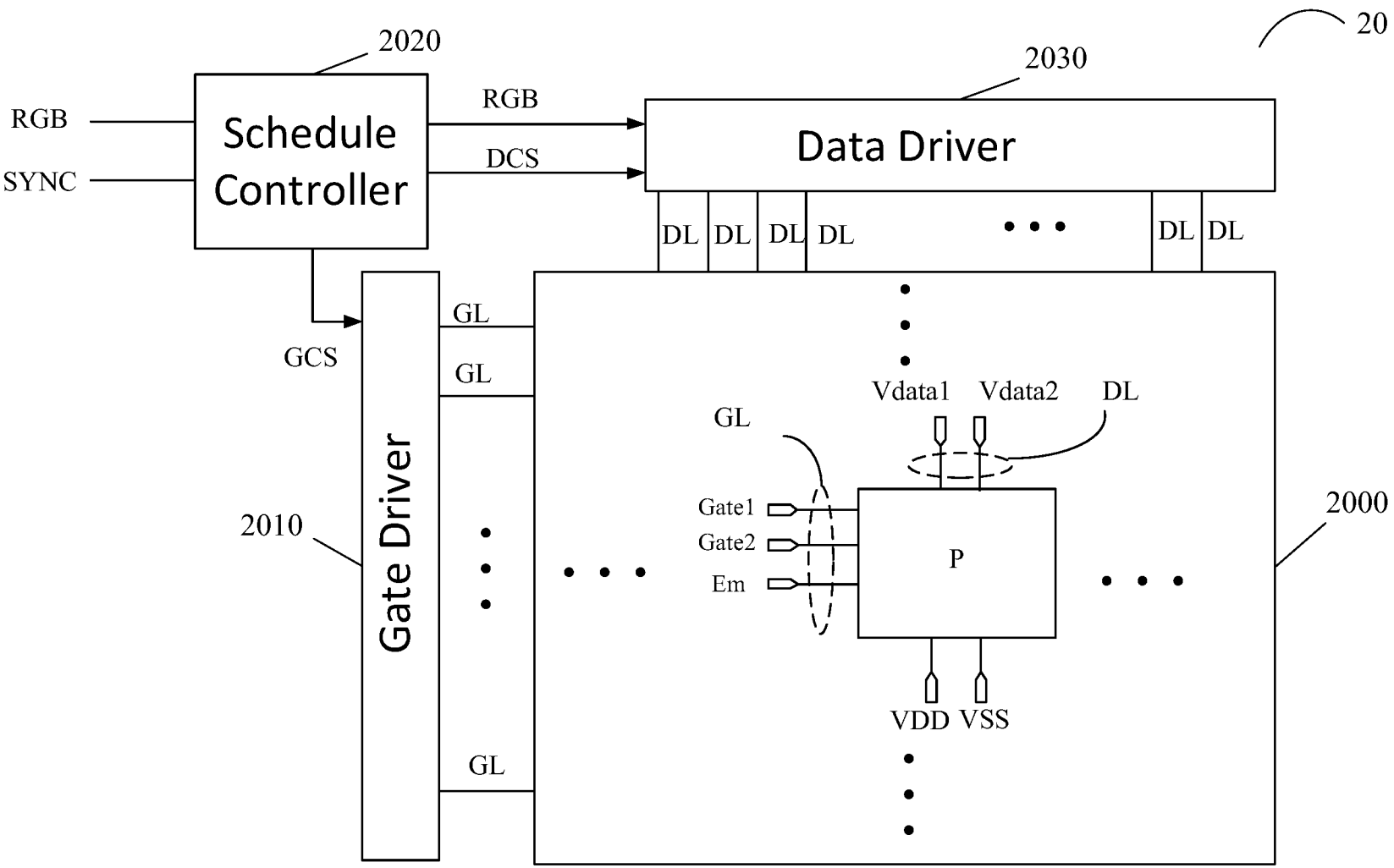
FIG. 14 is a schematic diagram of a display panel according to an embodiment of the present disclosure.

FIG. 14 is a schematic diagram of a display panel according to an embodiment of the present disclosure. Referring to FIG. 14, a display panel 2000 is set in a display apparatus 20. The display panel is coupled with a gate driver 2010 and a data driver 2030. The display apparatus 20 also includes a schedule controller 2020. The display panel 2000 includes multiple pixel units P combined by multiple scan lines GL and multiple data lines DL crossing over each other. The gate driver 2010 is used to drive the multiple scan lines GL. The data driver 2030 is used to driver the multiple data lines DL. The schedule controller 2020 is used to process image data RGB inputted externally and provide processed image data RGB to the data driver 2030 as well as output scan control signal GCS to the gate driver 2010 and data control signal DCS to the data driver 2030, for controlling the gate driver 2010 and the data driver 2030.

Optionally, the display panel 2000 includes multiple pixel units P. A respective one of the multiple pixel units P includes the pixel circuit 10 in several embodiments described herein. For example, the pixel unit includes the pixel circuit 10 shown in FIG. 10 or FIG. 11. As shown in FIG. 14, the display panel 2000 also includes multiple scan lines GL and multiple data lines DL. Optionally, pixel units P are respectively set in multiple cross regions of the multiple scan lines GL and multiple data lines DL. Optionally, the respective one pixel unit P is connected with three scan lines GL (for respectively supplying a first scan signal, a second scan signal, and an emission-control signal), two data lines DL (for respectively supplying a first data signal and a second data signal), a first voltage line for providing a first voltage, and a second voltage line for providing a second voltage. Optionally, the first voltage line or the second voltage line may be replaced by a corresponding plate-shaped common electrode (such as a common anode or a common cathode).

Optionally, the gate driver 2010 is configured to supply multiple gating signals respectively to multiple scan lines GL based on multiple scan control signals GCS originated from the schedule controller 2020. The multiple gating signals includes a first scan signal, a second scan signal, and an emission-control signal, etc. These gating signals are sent to the respective one pixel unit P via multiple scan lines GL.

Optionally, the data driver 2030 uses a reference Gamma voltage to convert digital image data RGB inputted from the schedule controller 2020 to display data signals (first data signals) and timing data signal (second data signals) based on multiple data control signals DCS originated from the schedule controller 2020. The data driver 2030 supplies the converted first data signals and the second data signals to multiple data lines DL. Optionally, the data driver 2030 also is connected with multiple first voltage lines and multiple second voltage lines respectively for supplying a first voltage and a second voltage to multiple pixel units P.

Optionally, the schedule controller 2020 is configured to process the image data RGB inputted externally for matching with the size and resolution of the display panel 2000. The schedule controller 2020 then supplies the processed image data to the data driver 2030. The schedule controller 2020 uses synchronized signals, including point clock signal DCLK, digital enabling signal DE, horizontal synchronize signal Hsync, and Vertical synchronize signal Vsync etc) inputted externally to the display apparatus to generate multiple scan control signals GCS and multiple data control signals DCS. The schedule controller 2020 is configured to respectively supply the gate driver 2010 and the data driver 2030 with the generated scan control signals GCS and the data control signals DCS for controlling the gate driver 2010 and the data driver 2030.

Optionally, the gate driver 2010 and the data driver 2030 can be formed in a semiconductor chip. The display apparatus 20 also includes other components such as signal decoder circuit, voltage conversion circuit, etc. Optionally, the display panel 2000 can be applied in one of the electronic book, smart phone, tablet computer, television, displayer, laptop computer, digital picture frame, navigator, or any product or component having a display function. In an example, the display panel is a Micro LED display panel.

Figure 15:
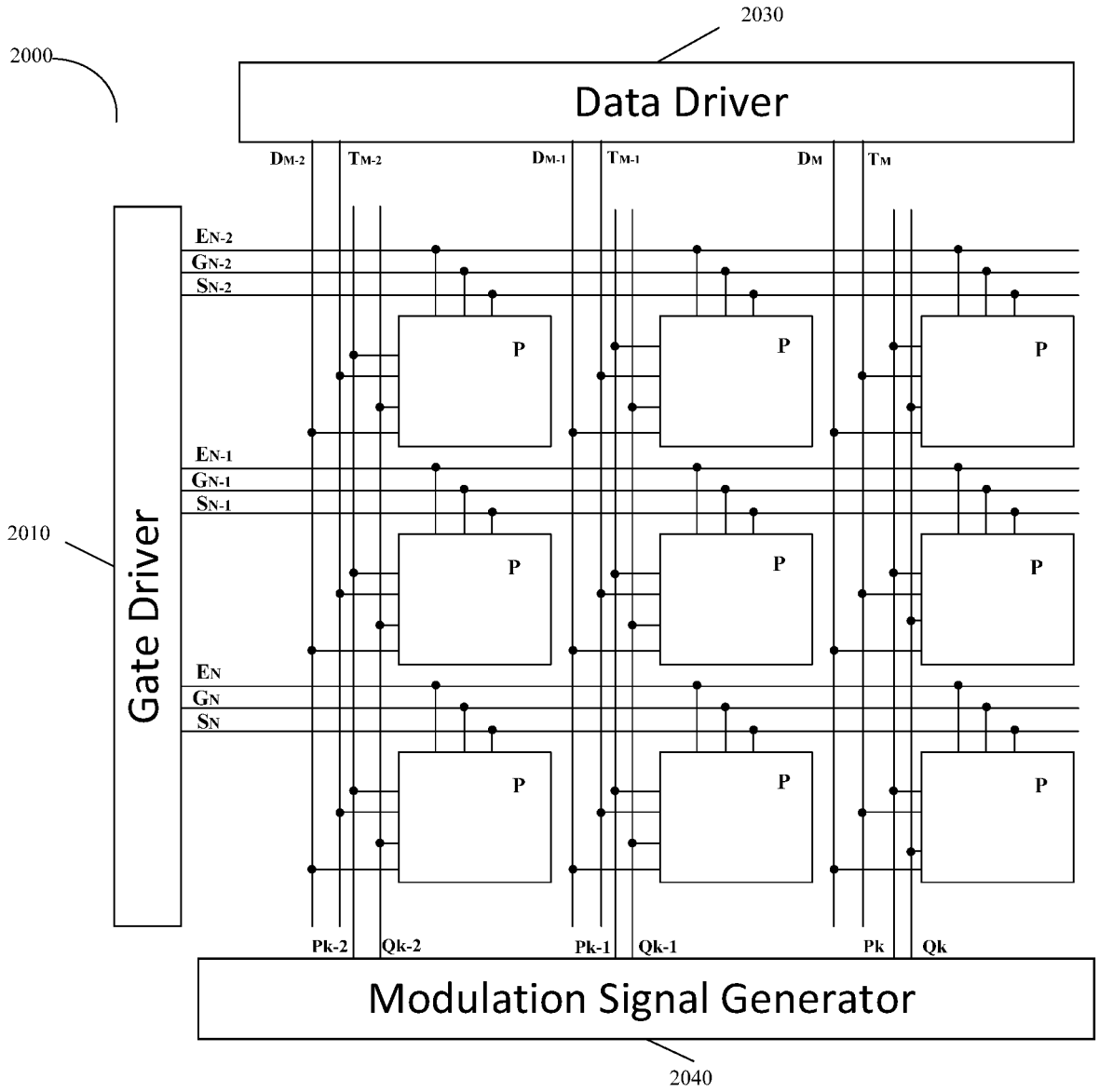
FIG. 15 is a schematic diagram of a display panel according to another embodiment of the present disclosure.

FIG. 15 is a schematic diagram of a display panel according to another embodiment of the present disclosure. Referring to FIG. 15, multiple pixel units P are arranged in a matrix with multiple rows and multiple columns. The display panel 2000 includes multiple first scan lines ($G_{N-2}$, $G_{N-1}$, $G_N$, etc.), multiple second scan lines ($S_{N-2}$, $S_{N-1}$, $S_N$, etc.), multiple emission-control lines ($E_{N-2}$, $E_{N-1}$, $E_N$, etc.), multiple timing-data lines ($T_{M-2}$, $T_{M-1}$, $T_M$, etc.), multiple display-data lines ($D_{M-2}$, $D_{M-1}$, $D_M$, etc.), multiple first modulation lines (Pk-2, Pk-1, Pk, etc.), and multiple second modulation lines (Qk-2, Qk-1, Qk, etc.).

Optionally, pixel circuits 10 in a same row of pixel units P are connected to a same one of the multiple emission-control lines ($E_{N-2}$, $E_{N-1}$, $E_N$, etc.) to receive a same emission-control signal Em. Pixel circuits 10 in a same row of pixel units P are connected to a same one of the multiple first scan lines ($G_{N-1}$, $G_{N-1}$, $G_N$, etc.) to receive a same first scan signal Gate1. Pixel circuits 10 in a same row of pixel units P are connected one of the multiple second scan lines ($S_{N-2}$, $S_{N-1}$, $S_N$, etc.) to receive a same second scan signal Gate2. Optionally, the first scan line and the second scan line that are connected to pixel circuits 10 in a same row of pixel units P are one scan line.

Optionally, pixel circuits 10 in a same column of pixel units P are connected to a same one of the multiple timing-data lines ($T_{M-2}$, $T_{M-1}$, $T_M$, etc.) to receive a same second data signal Vdata2. Pixel circuits 10 in a same column of pixel units P are connected to a same one of the multiple display-data lines ($D_{M-2}$, $D_{M-1}$, $D_M$, etc.) to receive a same first data signal Vdata1. Optionally, the timing data line and the display data line that are connected to pixel circuits 10 in a same column of pixel units P are one data line. This data line is configured to respectively supply the first data signal and the second data signal in different times so as to reduce number of signal lines in the display panel.

Optionally, the pixel circuits 10 in a same column of pixel units Pare connected to a same one of the multiple first modulation lines (Pk-2, Pk-1, Pk, etc.) to receive a same first modulation signal PWM1, and also are connected to a same one of the multiple second modulation lines (Qk-2, Qk-1, Qk, etc.) to receive a same second modulation signal PWM2. Alternatively, the pixel circuits 10 in a same row of pixel units P are connected to a same first modulation line to receive the first modulation signal PWM1, and also are connected to a same second modulation line to receive the second modulation signal PWM2.

Optionally, the display panel 2000 also includes a scan driver circuit (for example, a gate driver 2010). The scan driver circuit is disposed on the display panel 2000 to form a Gate-driver On Array (GOA) to connect with multiple first scan lines ($G_{N-2}$, $G_{N-1}$, $G_N$, etc.) and multiple second scan lines ($S_{N-2}$, $S_{N-1}$, $S_N$, etc.) configured to respectively supply the first scan signal and the second signal to a respective one pixel circuit 10. Optionally, the display panel 2000 further includes a data driver circuit (i.e., a data driver 2030). The data driver circuit also is disposed on the display panel 2000 to connect to with multiple timing-data lines ($T_{M-2}$, $T_{M-1}$, $T_M$, etc.) and multiple display-data lines ($D_{M-2}$, $D_{M-1}$, $D_M$, etc.) configured to respectively supply the second data signal and the first data signal to the respective one pixel circuit 10. Optionally, the display panel 2000 also includes a modulation-signal generator circuit 2040. The modulation-signal generator circuit 2040 is disposed on the display panel 2000 to connect with multiple first modulation lines (Pk-2, Pk-1, Pk, etc.) and multiple second modulation lines (Qk-2, Qk-1, Qk, etc.) configured to supply multiple modulation signals (e.g., first modulation signal PWM1 and second modulation signal PWM2) to the respective one pixel circuit 10.

In yet another aspect, the present disclosure provides a method for driving the pixel circuit described herein. Using this method, both a magnitude of a driving current and an emission time can be used to control grayscale levels for a display panel to enhance contrast and make the light-emitting device in the display panel to work within a relatively high emission efficiency region for full grayscale levels.

In an embodiment, the method includes following steps:

Inputting a first data signal, a second data signal, and multiple modulation signals; using a current-control circuit of the pixel circuit to control a magnitude of a driving current outputted to a first output node based on the first data signal; using a timing-control circuit of the pixel circuit to select one of the multiple modulation signals based on the second data signal, to receive the driving current, and control a time duration for the driving current to pass through a second output node based on the second data signal; and using a light-emitting device to be driven by the driving current to emit light based on the time duration controlled by the timing-control circuit.

Optionally, the driving current is provided to make the light-emitting device working in a region with stable emission efficiency, such as a region associated with a current density range J1~J2 shown in FIG. 1.

In another embodiment, the method of driving the pixel circuit 10 (e.g., of FIG. 10) includes following steps:

In a display-data-input period (such as the first period 1), writing a first data signal from the first data-signal terminal Vdata1 to the current-control circuit to control the driving current outputted to the first output node.

In a timing-data-input period (such as the second period 2), outputting a second data signal from the second data-signal terminal Vdata2, outputting a second scan signal from the second scan-signal terminal Gate2, and outputting multiple modulation signals from multiple modulation-signal terminals PWM1~PWMn. Selecting one of the multiple modulation signals based on the second data signal. Receiving the driving current. Outputting the driving current to the second output node based on the selected one modulation signal.

In an emission period (such as the third period 3), driving the light-emitting device to emit light based on the driving current.

In yet another embodiment, the method of driving the pixel circuit includes the following steps:

Ina display-data-input period (such as the first period 1), writing the first data signal from the first data-signal terminal Vdata1 to the current-control circuit to control a magnitude of the driving current outputted to the first output node.

In a timing-data-input period (such as the second period 2), writing the second data signal from the second data-signal terminal Vdata2 through the timing-data-input circuit to the first control node. Storing the second data signal at the first control node to a first storage circuit. Selecting one modulation signal out of the multiple modulation signals from the multiple modulation-signal terminals PWM1~PWMn under a control of the first control node. Writing the selected one modulation signal to a first node. Drive a switch circuit to response to the modulation signal written to the first node to determine whether the driving current passes through a third output node to the second output node.

In an emission period (such as the third period 3), driving the light-emitting device to emit light based on the magnitude of the driving current within a time duration when the light-emitting device receives the driving current.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel circuit comprising:

a current-control circuit coupled respectively to a first data-signal terminal, a first voltage terminal, a first scan-signal terminal, and a first output node, and configured to output a driving current to the first output node based on a first data signal from the first data-signal terminal and a first voltage signal from the first voltage terminal in response to a first scan signal from the first scan-signal terminal;

a timing-control circuit coupled respectively to a second data-signal terminal, a second scan-signal terminal, multiple modulation-signal terminals, the first output node, and a second output node, and configured to select one modulation signal out of multiple modulation signals respectively from the multiple modulation-signal terminals based on a second data signal from the second data-signal terminal in response to a second scan signal from the second scan-signal terminal, to receive the driving current from the current-control circuit and to output the driving current via the second output node based on the modulation signal selected thereby;

wherein the second output node is coupled to a light-emitting device configured to emit light based on the driving current.

2. The pixel circuit of claim 1, wherein the timing-control circuit comprises:

a timing-data-input circuit connected to the second scan-signal terminal, the second data-signal terminal, and a first control node, and configured to write the second data signal to the first control node in response to the second scan signal;

a selection circuit connected to the first control node, the multiple modulation-signal terminals, and a first node, and configured to select one modulation signal out of the multiple modulation signals under control of the first control node and to write the one modulation signal selected to the first node;

a first storage circuit connected to the first control node and a third voltage terminal, and configured to store the second data signal written from the timing-data-input circuit; and a switch circuit connected to the first node, the first output node, and a third output node, and configured to control whether the driving current passes through the third output node in response to one modulation signal written to the first node.

3. A method for driving the pixel circuit of claim 2 in one cycle of displaying a frame of image comprising:

writing a first data signal in a display-data-input period of the one cycle from the first data-signal terminal to the current-control circuit to control a driving current outputted to a first output node;

writing a second data signal from the second data-signal terminal to the first output node via the timing-data-input circuit, storing the second data signal written into a first control node by a first storage circuit, and selecting one modulation signal out of the multiple modulation signals respectively from the multiple modulation-signal terminals in a timing-data-input period of the one cycle;

writing the one modulation signal selected thereof to a first node;

controlling whether the driving current is passed through a third output node to the second output node in response to the one modulation signal; and emitting light based on the driving current in an emission period of the one cycle.

4. The pixel circuit of claim 2, wherein the third output node is connected to the second output node; and wherein the timing-control circuit further comprises an emission-control circuit respectively connected to the third output node, the second output node, and an emission-control-signal terminal, and configured to control whether the driving current passes through the second output node in response to an emission-control signal from the emission-control-signal terminal.

5. The pixel circuit of claim 4, wherein the emission-control circuit comprises an eighth transistor having a gate terminal coupled to the emission-control-signal terminal for receiving the emission-control signal, a first terminal coupled to the third output node, and a second terminal coupled to the second output node.

6. The pixel circuit of claim 2, wherein the selection circuit comprises a first selection sub-circuit and a second selection sub-circuit, the multiple modulation-signal terminals comprise a first modulation-signal terminal and a second modulation-signal terminal;

wherein the first selection sub-circuit is connected respectively to the first control node, the first modulation-signal terminal, and the first node, and is configured to write a first modulation signal from the first modulation-signal terminal to the first node under control of the first control node; and wherein the second selection sub-circuit is connected respectively to the first control node, the second modulation-signal terminal, the first node, a fourth voltage terminal, and a fifth voltage terminal, and is configured to write a second modulation signal from the second modulation-signal terminal to the first node under control of the first control node.

7. The pixel circuit of claim 6, wherein the first selection sub-circuit comprises a first transistor having a gate connected to the first control node, a first terminal connected to the first modulation-signal terminal for receiving the first modulation signal, and a second terminal connected to the first node;

the second selection sub-circuit comprises a second transistor having a gate connected to the first control node, a first terminal connected to the first node, and a second terminal connected to the second modulation-signal terminal for receiving the second modulation signal; and the first transistor and the second transistor are opposite in conduction characteristics being either P-type or N-type.

8. The pixel circuit of claim 6, wherein the first selection sub-circuit comprises a first transistor having a gate connected to the first control node, a first terminal connected to the first modulation-signal terminal for receiving the first modulation signal, and a second terminal connected to the first node; and the second selection sub-circuit comprises an inversion circuit having a first terminal connected to the first control node and a second terminal connected to a gate terminal of a third transistor, the third transistor having a first terminal connected to the first node and a second terminal connected to the second modulation-signal terminal for receiving the second modulation signal.

9. The pixel circuit of claim 8, wherein the inversion circuit comprises a fourth transistor and a fifth transistor;

wherein the fourth transistor has a gate terminal and a first terminal connected commonly to the fourth voltage terminal, and a second terminal connected to the gate terminal of the third transistor; and wherein the fifth transistor has a gate terminal connected to the first control node, a first terminal connected to the gate terminal of the third transistor, and a second terminal connected to the fifth voltage terminal.

10. The pixel circuit of claim 2, wherein the timing-data-input circuit comprises a sixth transistor having a gate terminal connected to the second scan-signal terminal for receiving a second scan signal, a first terminal connected to the second data-signal terminal for receiving the second data signal, and a second terminal connected to the first control node.

11. The pixel circuit of claim 2, wherein the switch circuit comprises a seventh transistor having a gate terminal coupled to the first node, a first terminal coupled to the first output node, and a second terminal coupled to the third output node.

12. The pixel circuit of claim 2, wherein the first storage circuit comprises a capacitor having a first terminal coupled to the first control node and a second terminal coupled to the third voltage terminal.

13. The pixel circuit of claim 2, wherein the current-control circuit comprises:

a display-data-input circuit connected respectively to the first data-signal terminal, the first scan-signal terminal, and a second control node, and configured to write the first data signal to the second control node in response to the first scan signal;

a driving circuit connected respectively to the second control node, the first voltage terminal, and the first output node, and configured to control a magnitude of the driving current; and a second storage circuit connected respectively to the second control node and the first voltage terminal and configured to store the first data signal written from the display-data-input circuit.

14. The pixel circuit of claim 13, wherein the display-data-input circuit comprises a ninth transistor having a gate terminal connected to the first scan-signal terminal for receiving the first scan signal, a first terminal connected to the first data-signal terminal for receiving the first data signal, and a second terminal connected to the second control node;

the driving circuit comprises a tenth transistor having a gate terminal connected to the second control node, a first terminal connected to the first voltage terminal, and a second terminal connected to the first output node; and the second storage circuit comprises a second capacitor having a first terminal connected to the second control node and a second terminal connected to the first voltage terminal.

15. The pixel circuit of claim 13, wherein the timing-control circuit comprises:

a timing-data-input circuit connected respectively to the second scan-signal terminal, the second data-signal terminal, and the first control node, and configured to write the second data signal to the first control node in response to the second scan signal;

a selection circuit connected respectively to the first control node, the multiple modulation-signal terminals, and a first node, and configured to select one modulation signal out of the multiple modulation signals under control of the first control node and to write one modulation signal selected thereof to the first node;

a first storage circuit connected respectively to the first control node and a third voltage terminal, and configured to store the second data signal written from the timing-data-input circuit;

a switch circuit connected respectively to the first node, the first output node, and the third output node, and configured to control whether the driving current passes through the third output node in response to the one modulation signal written to the first node; and wherein the second data-signal terminal and the first data-signal terminal are commonly connected to one data line for respectively receiving the second data signal and the first data signal, the first scan-signal terminal is connected to a first scan line for receiving the first scan signal, the second scan-signal terminal is connected to a second scan line for receiving the second scan signal.

16. The pixel circuit of claim 13, wherein the timing-control circuit comprises:

a timing-data-input circuit connected respectively to the second scan-signal terminal, the second data-signal terminal, and the first control node, and configured to write the second data signal to the first control node in response to the second scan signal;

a selection circuit connected respectively to the first control node, the multiple modulation-signal terminals, and a first node, and configured to select one modulation signal out of the multiple modulation signals under control of the first control node and to write one modulation signal selected thereof to the first node;

a first storage circuit connected respectively to the first control node and a third voltage terminal, and configured to store the second data signal written from the timing-data-input circuit;

a switch circuit connected respectively to the first node, the first output node, and the third output node, and configured to control whether the driving current passes through the third output node in response to the one modulation signal written to the first node; and wherein the first scan-signal terminal and the second scan-signal terminal are commonly connected to one scan line for respectively receiving the first scan signal and the second scan signal, the second data-signal terminal is connected to a timing-data line for receiving the second data signal, the first data-signal terminal is connected to a display-data line for receiving the first data signal.

17. The pixel circuit of any one of claims 1 to 4, wherein the light-emitting device is a micro light-emitting diode (LED) having a length no greater than 100 μm.

18. A display panel comprising an array of multiple pixel units, a respective one of multiple pixel units comprising a pixel circuit according to any one of claims 1 to 17.

19. The display panel of claim 18, further comprising multiple first scan lines, multiple second scan lines, multiple emission-control lines, multiple timing-data lines, multiple display-data lines, multiple first modulation lines, and multiple second modulation lines, and further comprising a scan-driving circuit, a data-driving circuit, and a modulation-signal-generation circuit;

wherein the multiple pixel units are arranged into multiple rows and columns, pixel circuits of a same row of pixel units are respectively connected to a same one of the multiple first scan lines for receiving a first scan signal commonly, connected to a same one of the multiple second scan lines for receiving a second scan signal commonly, and connected to a same one of the multiple emission-control lines for receiving an emission-control signal commonly;

wherein pixel circuits of a same column of pixel units are respectively connected to a same one of the multiple timing-data lines for receiving a second data signal commonly, and connected to a same one of the multiple display-data lines for receiving a first data signal commonly;

wherein the pixel circuits of a same row or a same column of pixel units are respectively connected to a same one of the multiple first modulation lines for receiving a first modulation signal commonly, and connected to a same one of the multiple second modulation lines for receiving a second modulation signal commonly;

wherein the scan-driving circuit is respectively connected to the multiple first scan lines and the multiple second scan lines, and configured to supply the first scan signal and the second scan signal for the pixel circuits;

wherein the data-driving circuit is respectively connected to the multiple display-data lines and the multiple timing-data lines, and configured to supply the first data signal and the second data signal for the pixel circuits;

wherein the modulation-signal-generation circuit is respectively connected to the multiple first modulation lines and the multiple second modulation lines, and configured to supply the first modulation signal and the second modulation signal to the pixel circuits;

wherein the first scan line and the second scan line that connect with the pixel circuits of a same row of pixel units are same one scan line; or the timing-data line and the display-data line that connect with the pixel circuits of a same column of pixel units are same one data line.

20. A method for driving the pixel circuit of any one of claims 1 to 17 in one cycle of displaying a frame of image comprising:

writing a first data signal in a display-data-input period of the one cycle from the first data-signal terminal to the current-control circuit to control a magnitude of a driving current outputted to a first output node;

supplying a second data signal from the second data-signal terminal, supplying a second scan signal from the second scan-signal terminal, and supplying multiple modulation signals respectively from the multiple modulation-signal terminals in a timing-data-input period of the one cycle;

selecting one modulation signal out of the multiple modulation signals based on the second data signal under control of the second scan signal;

receiving the driving current from the first output node;

passing the driving current in a time duration based on the one modulation signal selected thereof to output the driving current via the second output node; and emitting light based on the magnitude of the driving current in the time duration of an emission period of the one cycle.

* * * * *